US010032334B2

(12) United States Patent
Cuddy et al.

(10) Patent No.: US 10,032,334 B2
(45) Date of Patent: Jul. 24, 2018

(54) SYSTEMS AND METHODS FOR ELECTRONIC GAME TRANSFORMATION

(71) Applicant: Circle Eight Games Inc., Reno, NV (US)

(72) Inventors: Ryan Cuddy, Reno, NV (US); Christopher Lundy, Reno, NV (US); Lyndsay Berger, Reno, NV (US); Frederick G. Nesemeier, Reno, NV (US); Gary F. Nesemeier, Byron, IL (US)

(73) Assignee: Circle Eight Games Inc., Reno, NV (US)

( * ) Notice: Subject to any disclaimer, the term of this patent is extended or adjusted under 35 U.S.C. 154(b) by 0 days.

(21) Appl. No.: 15/619,394

(22) Filed: Jun. 9, 2017

(65) Prior Publication Data

US 2017/0278344 A1 Sep. 28, 2017

Related U.S. Application Data

(63) Continuation-in-part of application No. 15/167,988, filed on May 27, 2016.

(60) Provisional application No. 62/310,723, filed on Mar. 19, 2016.

(51) Int. Cl.
*A63F 9/00* (2006.01)
*G07F 17/32* (2006.01)

(52) U.S. Cl.
CPC ..... *G07F 17/3227* (2013.01); *G07F 17/323* (2013.01); *G07F 17/3204* (2013.01); *G07F 17/3218* (2013.01); *G07F 17/3255* (2013.01); *G07F 17/3258* (2013.01); *G07F 17/3288* (2013.01)

(58) Field of Classification Search
None
See application file for complete search history.

(56) References Cited

U.S. PATENT DOCUMENTS

| | | | | |
|---|---|---|---|---|
| 6,846,238 | B2 | 1/2005 | Wells | |
| 6,896,618 | B2 | 5/2005 | Benoy et al. | |
| 6,997,803 | B2 | 2/2006 | Lemay et al. | |
| 7,611,409 | B2 | 11/2009 | Muir et al. | |
| 7,699,703 | B2 | 4/2010 | Muir et al. | |
| 7,850,528 | B2 | 12/2010 | Wells | |
| 8,282,489 | B2 * | 10/2012 | Arezina | G07F 17/32 463/12 |
| 8,376,846 | B1 | 2/2013 | DiMichele et al. | |
| 8,771,063 | B1 | 7/2014 | Boyle | |
| 8,956,222 | B2 | 2/2015 | Lemay et al. | |
| 9,235,953 | B2 | 1/2016 | Earley et al. | |
| 2002/0090985 | A1 | 7/2002 | Tochner et al. | |
| 2004/0132530 | A1 | 7/2004 | Rutanen et al. | |
| 2006/0025222 | A1 | 2/2006 | Sekine et al. | |
| 2007/0259706 | A1 | 11/2007 | Anderson et al. | |
| 2007/0275777 | A1 | 11/2007 | Walker et al. | |

(Continued)

*Primary Examiner* — Seng H Lim

(74) *Attorney, Agent, or Firm* — Patentizer®, LLC; D.C. Williams

(57) ABSTRACT

The present invention relates to systems and methods to administer non-wagering entertainment games suitable for play on personal electronic devices and corresponding wager-based games available on electronic game machines within a regulated casino environment in a manner that permits users to earn benefits for play on one platform based on participation on the other platform.

20 Claims, 6 Drawing Sheets

(56) References Cited

U.S. PATENT DOCUMENTS

2008/0096628 A1 4/2008 Czyzewski
2008/0305873 A1 12/2008 Zheng
2011/0207531 A1 8/2011 Gagner et al.
2012/0015735 A1 1/2012 Abouchar et al.
2012/0122558 A1 5/2012 Lyons et al.
2012/0302324 A1 11/2012 Guinn et al.
2013/0017884 A1 1/2013 Price et al.
2013/0059650 A1 3/2013 Sylla et al.
2013/0084939 A1 4/2013 Nicely
2013/0095914 A1* 4/2013 Allen ..... G07F 17/3225 463/25
2013/0203489 A1 8/2013 Lyons et al.
2013/0203490 A1 8/2013 Hilbert et al.
2013/0281189 A1* 10/2013 Gagner ..... G07F 17/3227 463/25
2013/0316808 A1 11/2013 Nelson et al.
2013/0337878 A1 12/2013 Shepherd et al.
2013/0344941 A1 12/2013 Nelson et al.
2014/0018155 A1 1/2014 Nelson et al.
2014/0094272 A1 4/2014 Kelly et al.
2014/0162750 A1 6/2014 Ryan
2014/0162768 A1 6/2014 Nelson et al.
2014/0370971 A1 12/2014 Kelly et al.
2015/0065219 A1 3/2015 Kiely et al.
2015/0206378 A1 7/2015 Brown et al.
2015/0206397 A1 7/2015 Nelson et al.
2016/0027249 A1 1/2016 Nelson et al.
2016/0063797 A1 3/2016 Shepherd et al.
2017/0076553 A1* 3/2017 Washington ..... G07F 17/3276

* cited by examiner

SYSTEMS AND METHODS FOR ELECTRONIC GAME TRANSFORMATION

RELATED APPLICATIONS

This application claims domestic benefit of co-owned U.S. Nonprovisional patent application Ser. No. 15/167,988, entitled "Systems and Methods for Corresponding Games on Multiple Platforms", filed May 27, 2016, which in turn claimed domestic benefit of U.S. Provisional Patent Application No. 62/310,723 entitled "Systems and Methods for Corresponding Games on Multiple Platforms", filed Mar. 19, 2016. Both of said Nonprovisional and said Provisional Applications are incorporated herein by reference in their entirety for all useful purposes. In the event of inconsistency between anything stated in this specification and anything incorporated by reference in this specification, this specification shall govern.

COPYRIGHT STATEMENT

This patent document contains material subject to copyright protection. The copyright owner consents to the storage and reproduction of the instant disclosure in exactly the form it appears in the Patent and Trademark Office records for all purposes associated with the instant application and patent. However, Applicant, its agents, and assigns reserve all copyright rights to this original work for any and all other purposes, particularly but not limited to such rights prohibiting appropriation of the original material herein for unauthorized use by other parties for any purpose. To the extent that any material herein may legitimately fall within the scope of any copyright protection previously claimed by another party, including material presented herein believed subject to the "Fair Use" doctrine, Applicant disclaims any intellectual property ownership thereof or copyright protection therefore.

FIELD OF THE INVENTION

The present invention relates to systems and methods to administer entertainment games suitable for play on personal electronic devices and corresponding wager-based games available on electronic game machines within a regulated casino environment in a manner that permits users to earn benefits for play on one platform based on participation on the other platform.

BACKGROUND

With the advent of new technology and increasingly sophisticated personal electronic devices, entertainment and amusement gaming is diluting a share of the public's long-standing interest in wager-based casino gaming. In particular, younger players are less captivated by spinning slot machine reels and video poker games than were previous generations. New technology has enabled the development of vibrant interactive entertainment games that are often available at low cost or are even free but which provide a trove of new features. Further, these games may be played at the user's preferred time and location without the need to travel to a licensed gaming establishment.

The term "personal electronic device" or "PED", denotes a class of portable devices generally comprising a compact but powerful computing engine coupled with additional specialized hardware. These devices are typically owned by users but may also be loaned or rented to users by third parties for their use. PED components typically include one or more processors, one or more memories including some of any of static RAM, dynamic RAM, flash memory, ROM, and PROM, at least one output device such as a display, one or more input device(s), and at least one high capacity battery. In many devices, an output device and an input device are combined in the form of a touch sensitive display configured to display images to the user and simultaneously receive input from the user by touching or swiping the face of the display. PEDs also typically comprise hardware, firmware, and software that provide users with the ability to capture, edit, and view high resolution digital camera images and video along with the ability to create and play sophisticated audio recordings. Other specialized components present in the majority of PEDs include one or more communication ports configured to provide data inputs and inputs via wired or wireless communication paths, accelerometers, lights, haptic devices, and the like. This description encompasses a wide variety of hardware devices available from an ever-increasing number of manufacturers.

PEDs are designed and configured by their manufacturers to execute one or more operating system(s) compatible with their specialized hardware. Conversely, it may be said that PED operating system(s) are written specifically for certain PED architectures and their specialized hardware. Either way, the principal distinction between different classifications of PEDs is the operating system ("OS") running on the device. Said OS handles all of the intrinsic lower-level operations required by the hardware and thereby provides a consistent interface for applications independent of specific hardware.

Just as personal computers are primarily used to execute a variety of computer programs (often referred to as "applications"), PEDs are also primarily used to execute programs of many types which are often referred to as mobile applications or "mobile apps" due to the highly portable nature of the device. Mobile apps are available to perform a wide variety of useful functions; a woefully incomplete list of the most widely-used mobile apps would include those configured for making and receiving telephone calls, sending and receiving e-mail, recording and playing music or video, accessing content on the Internet including streaming audio and video, and playing entertainment or amusement games. Mobile apps written for a particular PED OS are generally compatible with all PED hardware running that particular OS, so specific hardware component differences between PEDs of different manufacture are usually not consequential to the design of mobile apps running on the various devices.

PEDs typically comprise multiple electronic communication ports that support a variety of wired and wireless protocols. Most notably, the vast majority of PEDs are configured to operate via one or more of the terrestrial-based common carrier technologies loosely categorized as "mobile communication" or "cellular communication". As a result, the majority of PEDs are referred to as "phones" by their owners and are frequently used to access common carrier communication resources by their owners. Via the Internet, PEDs are capable of almost all of the same data transmission and retrieval functions as are more powerful and sophisticated devices.

In addition to common carrier capability, most PEDS are also configured to communicate via other technologies such as Wi-Fi®, Bluetooth®, infrared transmission and reception, and the like, and these protocols enable the devices to access other PEDS, peripherals, electronics, third party resources, or even household appliances. Given the increasing capability of PEDs and the exploding quantity of mobile apps they support, additional uses are rapidly being developed for PEDs due to their capability and configurability as communication devices.

The wager-based electronic gaming machine ("EGM") is well known in the art and offers players an opportunity to place a wager using cash or a cash equivalent in return for an opportunity to receive a cash or cash equivalent award calculated according to posted odds based on a random gaming outcome. EGMs are highly specialized computing and electromechanical devices comprising one or more processors, memories, network communication capability, one or more user input devices, one or more output devices, one or more power supplies, sophisticated anti-tampering and fraud monitoring devices, and comprehensive security means embedded throughout each of the EGM's various subsystems to ensure operation of the machine in a manner consistent with the design of the game in compliance with all applicable gaming laws and regulations of the jurisdiction in which it is licensed. Due to the fact that EGMs may accept and dispense large quantities of cash or cash equivalents, security is paramount in their design and operation.

As with PEDs, EGMs may also be configured to offer a myriad of games, including but not limited to mechanical spinning reel slot machine games, all-video depictions of spinning reel slot machine games, video poker, video depictions of other card-based games, keno, adventure games, arcade-style games, role-playing games, and the like. EGMs are manufactured around the world by a number of companies licensed to do so by one or more gaming jurisdictions.

While EGMs are sold or leased as an operative unit comprising hardware, firmware and software necessary to provide low level operation of said hardware along with high level software and firmware necessary to execute one or more games on the EGM, the game software and firmware may benefit from or be dependent on some degree of third party development or administration for at least a portion of the EGM's execution. A well-known example of this dependence include EGMs linked to IGT's progressive "Megajackpots®" slot series, where very high value jackpots are funded and awarded across a base of machines disposed at many separate locations. Data communications pertaining to the value of the jackpots presently available to be won, the amount of funding provided by each machine toward the progressive jackpot to be awarded, and ultimately the selection of the machine to which the jackpot will be awarded must be communicated to each of the participating machines on a recurring basis. In this sense, EGMs linked to Megajackpots® are dependent on communication with external resources for their proper operation.

Unlike PEDs operating on common carrier networks, and with very few exceptions, EGMs are universally configured to communicate only with authorized servers within the confines of a highly secured gaming network typically confined to a single physical establishment. In some cases, the secured gaming network may comprise more than one physical establishment, but in those cases the secured network is usually operative to include all such establishments within the topology of said network, effectively forming a single secured network comprising network components disposed at multiple locations. While PEDs typically communicate within common carrier (such as cellular) networks where access by and to other devices is only loosely controlled, access to networks supporting EGMs is very tightly controlled to prevent unauthorized access to the devices on the network and the data they share.

The amounts of payouts for all specific gaming outcomes are computed by the developer of each game generally based on the odds of achieving such payouts and are inversely related. That is, the odds of a patron receiving a smaller payout based on any specific outcome are much greater than the odds of the patron receiving a larger payout. Correspondingly, there are many small payouts awarded during game play and significantly fewer large payouts since the odds of awarding larger payouts are much smaller than those associated with smaller payouts.

Wagering games may also be described in terms of their "volatility". Games that provide patrons with slightly better odds of receiving a larger payout while simultaneously providing slightly worse odds of receiving a smaller payout are said to have a higher volatility than other games which are configured to provide a greater number of smaller payouts with a concomitant decrease in the odds of awarding a larger payout.

An important consideration in any wagering game is the advantage enjoyed by the house. While the percentage of money wagered on a particular machine that is returned to players calculated over time will vary based on the many factors, including the gaming operator's preference, EGMs are carefully designed and configured to retain a known, predetermined percentage of the total wagers to insure profitability for the machine.

Given the demographic shift toward entertainment and amusement games played on PEDS and away from legacy casino games, what is needed are systems and methods that provide a nexus between mobile game applications and casino wager-based games that, among other advantages, introduce users of mobile applications the excitement of wager-based casino gaming. This may be accomplished by providing hardware systems and game methods of a common theme suitable for play on both PEDs and EGMs, where one particularly notable advantage of providing versions of a common theme game operating on each platform is that said game versions are configured to advance the players' status on the wager-based game via play of the mobile application.

BRIEF SUMMARY OF SOME ASPECTS OF THE INVENTION

Throughout this disclosure, the terms "user", "patron", and "player", whether in their singular or plural forms, may be used interchangeably to refer to one or more person(s) participating in one or more game play or related activities described herein, whether such activities comprise playing a game or performing a function incidental to the play of such game or games.

Various embodiments of Applicant's system comprise one or more mobile game application(s), commonly known as mobile app(s), designed for and configured for use on PEDs, one or more wager-based games designed for and configured for use on EGMs, and a plurality of specialized hardware devices configured to establish and enable communications between said PED(s) and EGM(s), provide operational control of said PED(s) and EGM(s), and secure the operation and interaction of said PED(s) and EGM(s) in compliance with applicable regulations and requirements for operation of wager-based EGM(s) in a casino or other authorized gaming environment.

In some embodiments, the mobile app is a game designed for and configured to operate on one or more types of PEDs owned by the user or provided thereto for temporary use only, including but not limited to computers, phones, tablets, phablets, electronic devices worn on the wrist (such as a "smartwatches"), personal digital assistants, or any other electronic device comprising input means suitable to control the mobile app, output means suitable to provide indication of game play to the user, and communication capability suitable to provide proper execution of the mobile app. Although a PED preferably comprises some manner of computing hardware, in some embodiments the PED will not comprise certain electronic components, including but not limited to the type of processor or memory, normally required of a device defined as a "computing device". Preferably, the mobile app is available for a plurality of the most popular PED operating systems representing the vast majority of devices in use, including but not limited to Android, iOS, and other operating systems such as versions and variants of Linux-derived, Windows Mobile, Blackberry, and Sailfish operating systems, or the like.

Throughout the scope of this disclosure, and unless specifically stated otherwise, all functions of any applications, including games, operating on a PED are performed directly on the PED itself without reliance upon any code or functions executing remotely, such as on a server or on any other computing device in communication with said PED, during play of the game. In other words, all games provided by a PED in this disclosure are provided solely by said PED via execution of software, firmware, or other functionality directly thereon. Specifically, the use of PEDs or other mobile electronic devices for remote input and output (display) purposes is well-known in the art and does not comprise the full degree of functionality required of the mobile app(s) envisioned by this disclosure. In these known embodiments, the actual gaming-specific firmware and software is resident on, and other functionality attributable to certain specific game requirements is provided by, one or more remotely disposed, separate, and distinct machines in continuous or periodic data communication with the PED during game play. The PED in these known embodiments only accepts input from and provides output to the user and does not, and cannot, provide the complete execution of the game without communicating with one or more external resource(s). In these known embodiments, the PED functions only as a means by which a user may interact with the remote resource(s) in data communication with the PED. This limited functionality provides the same high level of game execution security as is provided when input and output for the game is provided directly by the machine on which the actual game functions are executed, such as when a user plays a wager-based game at an electronic gaming machine ("EGM"). Unless otherwise disclosed with respect to certain embodiment(s), every game executed by a PED within the scope of this disclosure is a game in which all input, output, code execution, outcome determination, and functionality related to the awarding of and game transformation via benefits and advantages accrued by a user is performed using only the resources, including but not limited to hardware, firmware, and software resources, of the PED without reliance on any external resources during execution of said game. Additional resources, including but not limited to software, images, and those providing additional game-related functionality, may be periodically received from remote sources, but the actual execution of the PED games is provided to the user in real time solely by the PED(s) of this disclosure without any reliance on any remote resources during the user's play of said games.

In some embodiments, the PED comprises a consumer-grade commodity off-the-shelf electronic device owned by a user that is neither configured nor suitable for use as an electronic gaming machine or for use as a component within a wager-based gaming system, nor suitable for the purpose of executing an application that comprises any manner of wagering game. Specifically, in these embodiments, said PED does not comprise the hardware, firmware, software, security measures, or any combination thereof necessary to effectively or securely provide a wagering game to a user. These devices are not configured for or capable of wager-based gaming. The PEDs of this particular set of embodiments typically enable the owner/user to achieve root-level access to the core operating system, any software or firmware operable thereunder, and any associated hardware including communication ports that would enable said owner/user to modify or manipulate said PED in a manner that would present a security risk to the operation of wager-based games. As a hypothetical example that illustrates why non-wagering games and wager based games would be inherently incompatible on a PED of this nature, an owner/user would be capable of downloading, or of developing and loading, an application on said PED that could be used to spoof an authorized device within a secure gaming system. Such application could impersonate an authorized wager-based game or monitor the input and output of any other application also resident on the PED, including a wager-based game, by intercepting communications between said wager-based game and a server within a secure gaming system and then perform unauthorized nefarious functions within said secure gaming system. With a wager-based game, the lack of security in the PEDs of these particular embodiments could enable an owner/user to modify the wager-based game to defeat any security provisions therein and manipulate said wager-based game in an unauthorized and insecure manner. In short, the PEDs of these embodiments are only capable of and suitable for providing an entertainment game where no wagering is involved and cannot securely provide both wager-based games and non-wager-based games; they are exclusively configured for and operable with non-wagering, entertainment-only games. In other words, there is a nonremediable security risk whenever a wager-based game is executed on any electronic device on which a user may install an unauthorized application, as that practice would require a device that is inherently insecure and insufficient for wager-based gaming purposes.

Restating the situation from the opposite perspective yields the same conclusion. If any electronic device, including but not limited to a PED, that has been configured for intended use in wager-based gaming or within a wager-based gaming system, was not sufficiently secured so as to prevent a user from installing unauthorized third party applications, such device would actually not be suitably configured for wager-based gaming for the reasons given above. The inescapable conclusion is that any device configured to provide a wager-based game may not also be configured to provide non-wagering games downloaded or developed by user owners or third parties. Any device configuration that properly provides either type of game (wagering or non-wagering) effectively precludes the other from being executed on that same device.

However, the limitation that the non-wagering game-specific PED devices of these embodiments are incapable of providing any manner of wager-based games does not preclude their communication with other devices which may be configured to provide wager-based games. For example, the PEDs of these embodiments may store and provide data relating to benefits and advantages accumulated by a user and communicate said data to one or more remote EGMs or secure gaming servers via any known secure protocol, including but not limited to SSL, TLS, HTTPS, or the like, or via any other insecure protocol which does not impinge upon the security of the EGM or server, such as SMS, HTTP, or the like. The mere communication of data from one electronic device, such as a PED, to a second electronic device, such as an EGM or secure gaming server, is markedly different from the execution of game code on a PED that might present a security risk to other games or applications operating thereon. The difference is based on the device upon which the associated functionality is executed. The former does not involve the execution of any code on the receiving device, such as an EGM or secure gaming server, and any such received data may be handled in a secure manner by said receiving device because said device would intentionally comprise the necessary security configuration(s) to receive data from said PED in a secure manner so as to prevent any breach. It is only when an application is executed on a potentially insecure device, such as a PED of these embodiments, that the security required within wager-based gaming systems may be circumvented. It is for this very reason that the insecure PEDs of these specific embodiments are inherently defined to be unsuitable for execution of any wager-based games and for operation within a gaming server. The methods of this invention therefore represent a significant improvement over the known art where PEDs and other personal electronic devices, mobile or fixed, are required to be configured to provide wager-based gaming, since the overwhelming majority of PEDs and other personal electronic devices owned by users are not so configured.

In some embodiments, the wager-based games are designed for and configured to operate on one or more types of EGMs typically found in highly regulated gaming establishments, such as casinos, where laws and regulations permit patrons to place monetary wagers and receive payouts based on game outcomes primarily determined by chance.

In general, the operational capabilities of PEDs and EGMs do not include the ability to execute applications specifically designed and implemented for the other device due to vast differences in the respective hardware, software, and operating systems. However, in some embodiments of the invention, a mobile app may be designed and configured to present the same general appearance and methods of game play to a PED user as does a game program executing on an EGM. In this manner, a mobile app user may experience a highly similar game play experience to that of an EGM user with the exception of the wagering and payouts provided by the EGM. For the purposes of this disclosure, a mobile app and an EGM wagering game, each designed and configured to operate exclusively on their respective device(s) but which present a recognizably common game play experience to users, are each referred to as a "corresponding game" and collectively as "corresponding games". Any first game may have more than one second corresponding games. A collection of games that comprise corresponding games with respect to the others in said collection are referred to as a family of corresponding games. Within this collection, each game is a corresponding game to every other game in that collection. For clarity, the corresponding game comprising a mobile app shall henceforth be referred to as "the PED game" and the corresponding game comprising a wager-based game suitable for execution on an EGM in a regulated gaming environment shall be referred to as "the EGM game"; this pair of corresponding games is a preferred embodiment of this invention. However, and without limitation, a PED game may also be a corresponding game to another PED game and an EGM game may also be corresponding game to another EGM game.

Similarly, the PED and the EGM are referred to herein as the "platforms" on which the PED game and the EGM game, respectively, are configured to operate. When referring to either platform, the other platform may be described as the "corresponding platform". The term "platform" as used herein is intended to refer to a particular set of hardware, firmware, and software that together comprise an electronic machine or device suitable to provide the intended gaming experience to a user. Platforms may be generally, but not exclusively, defined as any configuration of elements that are capable of executing any particular instance of electronic game code; a first electronic device incapable of executing game code that may be successfully executed by a second electronic device will generally comprise a different platform than the second. Platforms are often defined by their operating system and may be classified as "open platforms", such as those comprising the Linux® or Android® operating systems, or they may be classified as "closed platforms", including but not limited to iOS® and Windows®.

Corresponding games may, but do not necessarily, comprise identical features, graphics, sounds, or game play methods. The most notable example of this is that PED games played independently of an EGM may not comprise the wager-based features providing players to receive cash payouts. As EGMs are typically configured with superior computing, display, and input capability, certain game features and methods may be enabled on that platform that are not practicable or possible on the less capable PEDs. However, in some embodiments, corresponding games on the two platforms are generally configured so that a player familiar with play on either platform will immediately recognize the game and also be familiar with play on the corresponding platform. In some embodiments, one game may serve as a simplified level for the corresponding game. A non-limiting example would be configuring the PED game with a streamlined graphic presentation or fewer objects that is better suited for the smaller display of the PED while configuring the EGM game with more objects, alternate views of the objects, additional information about the game or the player's status, or the like. For example, the PED game may comprise a video depiction of a three reel slot machine while the EGM game may depict a five reel video slot machine. In some embodiments, one game, such as the PED game, may present an introductory level of a game scenario and the corresponding game, such as the EGM game, may present more advanced levels.

In some embodiments of the invention, the recognizable similarity of corresponding games may be established by at least one of any of a common or similar game theme, a common or similar graphics presentation, common or similar colors or color changes, a common or similar name, common or similar characters, common or similar game elements, common or similar placement of game elements in the game presentation, common or similar sounds, common or similar math models, common or similar movements (such as velocity, acceleration, trajectories, etc.) of game or display elements, or the like, including any combination of any of the foregoing. It is impossible to define or describe all means by which individuals recognize similarities between different instances of objects, activities, or presentations, but the essence of corresponding games as taught in this disclosure may be defined as the presence of some combination of one or more characteristics present in each game that is sufficient for the typical user familiar with either version of the game on either platform to recognize and associate that game with the corresponding game on the corresponding platform. Accordingly, any such combination that enables a typical user to appreciate correspondence between the two game versions falls within the scope of this disclosure.

As is customary in gaming, a principal goal in a PED game or an EGM game is for a player to progress through the game seeking to fulfill challenges such as, for example, earning various new game play opportunities including bonuses or free games, advancing through a series of game levels of increasing complexity, accumulating objects or certain combinations of objects, perhaps in a particular order, striving to improve upon an earlier metric in terms of points, maximum elapsed playing time or time to completion of certain tasks, attainment of any other task or any other metric, or the like. This list is necessarily incomplete, as the myriad of games available present players with a vast assortment of possibilities that cannot possibly be enumerated in any written description and are dependent on the particular aspects of each game. In addition to all of the features available to players in PED games, wager-based EGM games provide players with the opportunity to receive cash payouts in return for their wager. Game play typically involves selection of one or more games, particular game features, or both, generation and display of a game presentation to a user according to a game method, communication of input to the game by the user, display of game result(s) from the game to the user, and in the case of EGM games, awarding a payout to the user when said result(s) are in agreement with a predetermined random or pseudo-random outcome. Any modification of the underlying game features, presentation, method, or the manner in which outcomes are determined or payouts are awarded comprises a change, alteration, modification, or transformation of game play experienced by the user.

The cooperative PED and EGM games that comprise a novel component of this invention and are described in greater detail elsewhere herein may also provide any of the same opportunities, challenges, and rewards that are applied directly to the game activity then underway in exactly the same manner as games known in the art. In that respect, the play of either the PED game alone or the EGM game alone as taught herein is a complete and fulfilling experience identical to that of known games, and the play of either corresponding game does not necessarily require interaction with a corresponding game on the other platform. In other words, there is no mandatory dependence between corresponding games on different platforms requiring participation on both platforms, as each game is independently operative of the other.

However, one novel element of some embodiments of Applicant's invention is an opportunity, rather than a requirement, for a user to link his playing experience on either the PED game or the EGM game to their play on the corresponding device or platform by applying certain benefits or advantages earned during play of a game one device or platform to their play of the corresponding game on the other device or platform. In this manner, the game played on the device or platform that receives and applies any benefits or advantages from another device or platform is transformed from its original first game play state to a second game play state different from the first game play state and thereby provides the user with a gaming experience not possible absent such benefit or advantage transfer. Transformation may comprise any change in the game presentation, content, game method, hardware interaction, pay table, volatility, or any other aspect of the game without limitation.

For example, a user who participates in play of the EGM game may receive certain benefits or advantages in play of the corresponding PED game. In other embodiments, the users of a PED game may receive certain benefits or advantages when playing the corresponding EGM game as described elsewhere herein. In some embodiments, said benefits and advantages may be accorded both ways; that is, play of either of the corresponding game versions may inure to the advantage of the user when playing the other version. In some embodiments, benefits and advantages earned via game play on a first device or first platform may provide a unique gaming experience on a second device or second platform not obtainable via play of the second device or platform alone. That is, certain benefits and advantages may only be earned on said first device or first platform for use on said second device or second platform and may not be earned via play on said second device or second platform. As such, game play on a first device or first platform and assignment of benefits and advantages awarded thereon may, in some embodiments, be the only manner by which play on said second device or second platform may be transformed.

Whenever used herein, the interchangeable terms "benefits and advantages", "benefits or advantages", and "benefit or advantage", whether referring to benefit(s) and advantage(s) in either singular or plural form, alone or in combination, are intended to refer to any one or more benefit, any one or more advantage, or any combination of one or more benefit(s) and one or more advantage(s) without the necessity to distinguish between benefit(s) and advantage(s), or the distinction between the aggregate form ("and") or the alternative form ("or") that may be alternately used.

The essential characteristic of benefits and advantages is that they comprise one or more instructions generated by a first electronic game that are operative to modify and transform the play of said second corresponding game in some manner preferably, but not necessarily, to enhance the gaming experience of a user. Said instructions may be directly applied to said second corresponding game by the electronic device on which it is executing, stored in a memory of said electronic device for retrieval by said second corresponding game, or conferred upon or otherwise operative to transform the play of said second corresponding game via any means now known or later developed.

The significance of the transformation of a second corresponding game must be appreciated to its full extent. While the corresponding game systems and methods described herein are directed toward electronic games, transformation of the structure and mechanical hardware depicted in certain embodiments of electronic games is no less of a transformation than would be transformation of the structure and mechanical hardware in their non-electronic counterparts. When a game is transformed from a first state, or game method, to a second state, or modified game method, the means by which said transformation has been provided is not germane to the transformation itself. In some instances, reconfiguration of certain aspects of an electromechanical game is neither feasible nor practicable while reconfiguration of an electronic version of that same electromechanical game would be relatively straightforward. If the same result has been achieved, both are equivalent transformations; as above, transformation of an electronic version of an electromechanical game is no less of a transformation than the same transformation of said electromechanical game, if such was even possible. This point will be emphasized below using the two most significant and ubiquitous electromechanical games from the era prior to the advent of electronic processors.

Pinball was an immensely popular electromechanical game played on an inclined surface (field), where typically, a steel ball shot by a player via a spring-loaded piston was kept in play on a field of bumpers, hazards, and point-scoring opportunities via the use of one or more pairs of player-operated flippers that directed the ball upward on the surface to remain in play and score points tabulated on a vertically-oriented electromechanical or electronic display. A series of relays and solenoids below the playing field were operative to re-direct the ball via a machine-supplied force applied to the ball whenever it contacted a bumper or hazard. Players were awarded "free plays" or reconfiguration changes to the playing surface when certain game conditions were met, including but not limited to attaining a certain point total, causing the ball to contact a series of bumpers or other table-mounted items (perhaps in a certain order), channeling the ball through a certain passage or into a recessed hole on the playing field, or the like. Reconfiguration changes included, but were not limited to, the flippers moving closer together so no space remained between them to prevent the ball from dropping out of play, opening a gate on the playing surface so the ball could be channeled back to the spring-loaded piston to be re-shot by the player instead of being lost, or causing one or more additional mechanical devices on the playing field to become operative to provide additional opportunities to earn points. These reconfiguration changes required one or more physical elements to effect such changes to other physical elements on the playing field. Typically, one or more relays or solenoids were operatively connected to one or more elements on the playing field to move the flippers, open or close a gate, or the like. These changes transformed the game from a first state to a second state and thereby provided a substantially altered gaming experience for the player. There is no doubt that such structure effecting a transformation of the electromechanical game would comprise patent-eligible subject matter under 35 USC § 101.

In some embodiments of the cooperative game system, an electromechanical pinball game is simulated via an electronic game using one or more video display(s) comprising an LCD, OLED, plasma, or any other type of video display. In some embodiments, said one or more video displays may comprise a three-dimensional video display of any type. In place of electromechanical bumpers, hazards, relays, solenoids, and the like mounted on and under a legacy pinball playing surface, a video depiction of field-mounted items is generated and displayed, and their operation is realistically simulated by the electronic system(s) comprised within the platform offering the electronic game. One or more buttons are provided for players to operate flippers in a manner identical to that provided in the electromechanical version. The dynamics of ball movement, field-mounted items, and player-operated flippers are presented in said electronic game so as to precisely duplicate the actual performance and behavior of the legacy electromechanical system.

Further, the electronic version of the pinball game may be configured to receive instructions to modify the behavior or availability of field-mounted items. In some embodiments, when a previously-accrued benefit or advantage is applied to the game of this embodiment, the video depiction of the flippers may be modified to reflect the separation between them closing in the same manner as is known in the art of electromechanical games. At the same time, the dynamics of the electronic game are adjusted to reflect the new placement of said flippers via the underlying code of the electronic game. The end result is that the transformation of the electronic pinball game has exactly the same effect on the play of that game as did physical transformation of the electromechanical game. In this example, a ball is effectively prevented from falling from play between the flippers as long as this transformation is in effect, and said transformation dramatically changes the playing conditions and gaming experience for the user. The mere fact that one transformation may be accomplished via electromechanical means and the other via electronic means is not germane to the fundamental nature of game transformation. In both cases, the electromechanical and electronic games are each transformed in identical ways via different means and therefore are both deserving of identical subject matter eligibility in view of the well-established Bilski-derived "machine or transformation" test.

Another highly applicable example of equivalent game transformation involves the predecessors of electronic gaming machines. Legacy electromechanical slot machines generally comprise from three to five mechanical reels upon which reel symbol strips are mounted, and gaming outcomes are determined by the positions of the reels as they randomly lock into place. Known art in the field of electromechanical slot machines does not teach a number of significant mechanical transformations, including the replacement of original reel strips with modified reel strips comprising the same or a different number of symbols thereon by any means other than via a manual process performed by authorized personnel. Neither does the known art teach the addition of a fourth or fifth reel to an electromechanical slot machine originally comprising only three mechanical reels, nor does it teach the removal of one or two reels from a game originally comprising five mechanical reels. Any of these significant transformations would provide an entirely different gaming experience for the user. There is good reason for the absence of prior teaching of these transformations of electromechanical games: these transformations are simply not feasible given the need for numerous modifications of highly regulated and secured physical machines in real time. Further, changing the number of symbols on a reel strip from a first number to a second number would necessitate replacing the entire original physical reel mechanism with a different physical reel mechanism properly configured for the second number of reel symbols. Any viable system or method of providing these game transformations would have been novel over the prior art and useful, but most significantly, there is no question that these physical game transformations would have comprised patent-eligible subject matter under 35 USC § 101. Again, it is important to understand that what is being transformed is the game itself and not the structure, as said structure is merely replaced by alternate structure and not transformed itself.

By comparison, electronic embodiments of reel-based electromechanical slot machines are highly transformable and may easily accommodate these and numerous other transformations not possible with physical electromechanical reels. In certain embodiments where slot machine reels are depicted via video simulation on electronic slot machines, altering the number of reels, the number of symbols on each reel, or the actual symbols themselves necessitates only the replacement of one or more set(s) of images for other set(s) of images along with substitution of replacement program code underlying the electronic game that corresponds to the replacement images. Further, in some embodiments, the video simulation of physical reels may be significantly improved via the use of specialized hardware. See, for example, "Realistic Video Reels", U.S. Pat. No. 8,357,033 by Williams et al. This and other patent-eligible technology of its type is feasible only on electronic hardware systems and not on the legacy electromechanical hardware systems being simulated on said electronic systems. Any transformation of a game executing on a first hardware system that is identical or equivalent to a transformation of a game executing on a second hardware system must be adjudged to be an equivalent transformation since it is the game that is being transformed and not the hardware itself, which is only a means to achieve game transformation. In other words, the particular means of effecting a transformation are not relevant to the subject matter eligibility of claims drawn to the transformation of a game. Accordingly, Applicant's claims drawn to the transformation of electronic game(s) via instructions created by a first game comprising benefits and advantages subsequently applied to a second game as taught by this written description are, at a minimum, unquestionably patent eligible under 35 USC § 101 pursuant to the Bilski "machine or transformation" test. Other aspects of Applicant's invention are additionally operative to demonstrate proper subject matter eligibility for the claims herein.

Any modification(s), alteration(s), or change(s) of a player's status with respect to either of the corresponding games that a player may deem to be desirable for the purposes of advancing his play on either platform, or that increase the likelihood of the player winning a cash award or increasing the amount of any cash awards available on the EGM game, or that increase a player's gaming experience for the better in any manner, is considered to be an element of one or more preferable embodiment(s) and to fall within the definition of the term "benefits and advantages" as used herein. Once again, the list of possible benefits and advantages available in the universe of games now available is staggering and entirely dependent upon the nature of the game method presented in the particular method(s) utilized in each set of corresponding games.

In some embodiments, benefits and advantages earned on one platform may be stored on that platform for later transfer to the corresponding platform. For example, benefits and advantages earned via play of the PED game may be persistently stored in one or more memories of the PED for later transfer to an EGM when the player commences play of the corresponding EGM game. In some embodiments, benefits and advantages earned while playing the EGM game may be temporarily stored on the EGM during the player's activities there. At the conclusion of play, or intermittently during such play, said benefits and advantages may be transferred from the EGM to the player's PED using the system and methods described elsewhere herein.

In some embodiments, the benefits and advantages earned by a player on either platform or device may be communicated to one or more third party servers for storage there according to the system and methods described elsewhere herein. Such stored information may then subsequently be retrieved by the user's PED or an EGM whenever the user next begins play of the corresponding game on either platform or device.

The use of third party servers for storage and retrieval of user data pertaining to benefits and advantages provides numerous additional embodiments of commercial opportunities for the operator(s) of said servers, including but not limited to the developers or promoters of the PED and EGM games. Along with any data relevant to the play of a particular game, additional games, game features, or other promotional or purchase offers may be made available to players based on their game play or any other information provided by the players. For example, when a new game is released, players of similar games may be afforded an opportunity to download the game before it is available to the general public, perhaps while still in beta testing. For games or other products that are not available free, users with an extensive history of other game play may be provided with the new game at no cost or at a discount, perhaps for only a limited time. When EGM games corresponding to PED games played by a player are placed in gaming establishments proximate to the player's home or preferred travel destination, notification of those placements may be provided to that player. Players may also be able to retrieve, either via the mobile app comprising one or more particular PED games or via direct access using a web browser or other means, the locations of all EGMs with a certain radius of a specified location that offer play of the corresponding game to facilitate players' effort to locate machines where they can enjoy any benefits and advantages earned via PED game play. As such location determinations or notifications inure to the benefit of the gaming establishments where those machine are located, the operator(s) of the third party servers may receive consideration from the operators of said gaming establishments in return for driving customers to their EGMs. These exemplary embodiments are also not limiting on the scope of this disclosure, as any number of alternate embodiments are enabled by the systems and methods of the invention.

In some embodiments, benefits and advantages transferable from one platform to the other may be generally of the same nature and therefore be directly relatable. That is, some aspect of a player's previous activity may benefit or further his performance of the same activity on the corresponding game. By way of examples, and without limitation, in games where players advance through various levels of increasing difficulty, a player who completes a certain number of levels on one platform may receive an automatic advancement of a certain number of levels on the corresponding game. Similarly, in role playing games, players whose character(s) have earned special abilities or other features on one platform may apply some or all of those abilities or features to their character(s) in the corresponding game, thereby transforming the game play. In games where the speed of the game accelerates as the player advances through levels, attainment of a certain level of progress in one game may earn the player a reduction in speed on the corresponding platform so the player may benefit from such advantage.

In some embodiments, any benefit or advantage earned by a player on one platform may transfer to the player's participation on the corresponding platform to the same degree. For example only and without limitation, a player who attains the sixth level on the PED game may transfer that progress to the EGM game and begin play on the sixth level from the outset. In some embodiments, only a portion of a benefit or advantage earned by a player may be permitted to transfer across platforms. Here, a player's sixth level status on the PED game may only earn the opportunity to begin EGM play on the third level. In some embodiments, a player may receive a greater benefit or advantage on the corresponding platform that was earned on the other. For example, a player who has advances four levels during play of the EGM game may be entitled to skip six levels on the PED game.

In some embodiments, the benefits and advantages transferable from one version of the game to the corresponding version may not necessarily be related to a similar activity. Also by way of non-limiting examples, players who have attained a certain level of progress or prowess on the PED game may receive more favorable odds on the wager-based game executing on the EGM. In other embodiments, the volatility of the EGM game or the operator's built-in advantage, or take, may be modified based on the player's participation with the PED game. Alternately, completion of a certain number of PED games may earn the player additional bonus game opportunities on the EGM game. As a final non-limiting example, playing a certain number of games on the EGM platform, or winning a payout above a certain level, may unlock additional features for that player on the PED version. Further, any additional benefits or advantages awarded to a player on one version of a corresponding game may enable the player to more easily earn additional benefits and advantages transferable to the other version of the corresponding game, without limitation.

Based on the foregoing description, a person of ordinary skill in the art will immediately recognize that the depth and breadth of Applicant's disclosure is sufficient to permit a game designer or promoter to recognize any potential benefit or advantage that may be valuable to a player and to provide that as a benefit or advantage transferable to a corresponding game on the other platform.

Awarding of multiple benefits and advantages are also enabled by this disclosure. In some embodiments, any particular family of corresponding games may have one or more types of benefits or advantages that are transferable within that family or to other corresponding games. Drawn from the previous examples, the level advancement benefit, the reduced game speed advantage, and the altered volatility benefit may all be eligible for transfer from one corresponding game to another. In some embodiments, the corresponding games may be configured to transfer any combination, up to and including all, of these benefits and advantages as they are earned by a player. In some embodiments, benefits and advantages eligible for transfer between games may be prioritized based on any criteria and transferred sequentially according to that priority, said transfer triggered by any conceivable factor or event such as the time between transfers, number of games played between transfers, the intervals between the time they were earned by the player, preferences provided by the player, randomly, or the like. In some embodiments, only a portion of the benefits and advantages earned by a player may be permitted to transfer between corresponding games. For example, a player who has earned more than one benefit or advantage may only receive a transfer of the most valuable benefit or advantage.

In some embodiments, the benefits and advantages transferable between the corresponding games may be determined by the games themselves. In these embodiments, each of the games are configured to determine when a player has earned a benefit or advantage and enable the transfer of that benefit or advantage at an appropriate opportunity, such as the next time the player begins play of the corresponding game. In some embodiments, the corresponding games may be configured to permit the player to select which of any earned benefits and advantages he prefers be transferred, when such transfer may occur, or both.

Such benefits may be either temporary or persistent in nature. That is, certain advantages may be provided for a set duration of play, provided for use within a period of time described by a starting date and time and an ending date and time, provided for a certain number of iterations of game play, provided until a certain event occurs during game play, provided until the player achieves a certain goal or objective during game play, or temporally defined by any other means desired. Certain advantages and benefits may also be provided on a persistent basis that are not temporally limited. As a non-limiting example, one such advantage may be that a user is permitted to advance from one level of play to a higher and more rewarding level while bypassing intermediate levels. In doing so, the user would never be required to complete the less desirable levels as a result of said advantage earned by playing the other version of the corresponding game.

In some embodiments, participation in play by a user in either or both versions of a corresponding game may inure to the benefit of one or more third parties. By way of example and not limitation, a user experienced in the play of any of a family of corresponding games may assign at least a portion of any benefit or advantage accrued from such play to one or more other users of his choice, thereby transferring some or all of said benefit or advantage for the purpose of introducing or encouraging others to participate in the playing of any corresponding game. This serves to develop interest in the family of games and increase revenue from play of the game, particularly when interest is developed for the play of the wager-based EGM game.

One objective of the present invention is to provide a solution to the problem stated above of increasing interest in casino-style wagering games by players of PED-based non-wagering (entertainment-only) games. In furtherance of this objective, additional novel methods are provided to incentivize players, hereinafter referred to as "proponents", to encourage and promote play of the non-wagering PED games to other players, thereby increasing both visibility and participation in corresponding wager-based games on EGMs. As above, one such method comprises allowing player proponents to assign some or all of any benefits or advantages accrued from their play of the non-wagering PED game or by other means, including promotional activities discussed elsewhere herein, to one or more other users of his choice. In some embodiments, such assignment(s) may be on an exclusive basis; that is, assigning a benefit or advantage to one other player inures only to the benefit of that one assigned user and removes it from use by the assigning player so it is no longer available to him. In this manner, only one player may benefit from any particular benefit or advantage during play of the non-wagering PED game, the wager-based EGM game, or both. In some embodiments of non-exclusive assignments, assigning any benefit or advantage from one player to another player does not require the assigning player to relinquish said benefit or advantage for his own use. In these embodiments, both the assigning player and the receiving player may apply said benefit(s) or advantage(s) to the play of their respective non-wagering PED game, wager-based EGM games, or both. In some embodiments, a player may assign a benefit or advantage to more than one other player, either on the exclusive or non-exclusive basis as described above. Any and all of these assignments may be applied to either temporary, persistent, or both types of benefits and advantages without restriction.

In some embodiments, player proponents may be incentivized to promote play of non-wagering PED games to one or more other potential player(s) by offering some form of compensation in exchange for promotional referral communications sent from the player proponent's device to the device of other potential player(s). Such compensation may comprise one or more prize(s) such as merchandise, tickets to entertainment events, hospitality considerations at gaming or non-gaming establishments, one or more additional game(s) or other applications compatible with a PED, complimentary play of wager-based EGM games, cash payment(s), or any other form of compensation, consideration, or remuneration desired by proponents. Such consideration may be provided by an operator of wager-based EGMs, the developer or other proponent of the non-wagering EGM games, the developer or other proponent of the wager-based EGM games, a distributor or representative of said operator(s) or developer(s), a third party that may benefit from play of either the non-wagering or wager-based games, or by any other party. Such compensation may be provided to the player proponent user, to the device used by the player proponent user to communicate said promotional referral, or to both.

In some embodiments, awards or other consideration provided to proponents may be provided by gaming establishment operators via integration with their player reward or loyalty programs.

In some embodiments, awards or other consideration provided to proponents may be provided by, sponsored by, or otherwise associated with third party affiliates. Such third party affiliates may, without limitation by example, include the manufacturers of PEDs including but not limited to consumer-grade commodity off-the-shelf electronic devices offered for sale to users that are neither configured nor suitable for use as an electronic gaming machine or to execute a wager-based game. Other potential third party affiliates include the communication service carriers on which such PEDs are configured to operate. For example, a particular PED manufacturer and a communication carrier on which its devices are configured to operate may, separately or in combination, offer hardware, additional network bandwidth, service fee discounts, or other benefits to corresponding game proponents in return for their promotional activities. Further, such third party affiliates may themselves be incentivized to engage in the promotion of the corresponding games for consideration. For example, a particular non-wagering PED game may be made available only to purchasers of particular PED(s), customers of one or more particular communication carrier(s), or to one or more particular device(s) on one or more particular network(s).

One novel element of some embodiments of the cooperative game methods described herein is the transformation of wager-based games on EGMs from a first game play state to a second game play state via benefit(s) and advantage(s) accrued during play of non-wagering games on PEDs. The goal of increasing visibility of the corresponding games may also be furthered using the same transformational framework. As disclosed elsewhere herein, players' accrual of benefit(s) and advantage(s) provide an enhanced gaming experience in one or more transformed second game play state(s). Any assignment of benefit(s) and advantage(s) from one player to one or more other player(s) provides this enhanced gaming experience in either the non-wagering game, the wager-based game, both of the above, or in a third game not associated with either the non-wagering game and the wager-based game for any player receiving such benefit(s) and advantage(s) indirectly via such assignment.

In some embodiments, a proponent player may be awarded, or receive an opportunity to acquire, one or more promotion-based benefit(s) or advantage(s) operable to transform the play of one or more electronic game(s) from a first game play state to a second game play state, such electronic game(s) including but not limited to either or both of the non-wagering game and the wager-based game or a third unrelated game, based on the degree to which such proponent has increased the play of any of the above games by virtue of his promotional activities. Such additional enhancements may comprise certain first level benefit(s) and advantage(s) that are available to be acquired but that have not already been accrued by the proponent by his own game play. Additional second level enhancements awarded for promotion may be benefit(s) and advantage(s) reserved specifically for this purpose that are not available to be acquired via game play. Likewise, certain combinations of first and second level benefit(s) and advantage(s) may be awarded to players in return for their promotion of either or both of the corresponding games. Certain components of these combinations may comprise benefit(s) and advantage(s) that increase the value of other components in that combination. For example, a benefit that transforms any other co-awarded components from a temporary benefit to a persistent benefit renders each of the other benefits in that combination more useful than if they were awarded separately, effectively providing a degree of synergy in the promotional award. Such synergistic effect may also be realized in the first or second level enhancements awarded singly or in combination for game play or promotional activities, respectively, but in order to encourage active players to promote the corresponding games to third parties, some preferred embodiments of these methods require both a certain degree of game play activity and a certain amount of promotional activity by a player to accrue the most desirable benefit(s) and advantage(s).

Awarding of promotional benefit(s) and advantage(s) may be based on any preferred criteria. In some embodiments, a first player on a first device may provide one or more second players on second devices with a link to one or more network server(s) where non-wagering electronic entertainment game(s) may be downloaded to their individual PEDs. In this case, the second player(s) would access said server(s), download the non-wagering game, and then install and execute said game(s) on the second device(s). Such download may be associated with the identification of the first device or the first player via any means that will enable the network server to attribute the second players' download to the first player's promotional activity, including but not limited to the use of an embedded string or other identification information specific to said first user within the URL referred to the second device. In some embodiments, the promotional referral by a first player to one or more second players may be communicated via an electronic game server which retains an accounting of all such referrals for the purpose of compensating the first player. Thereafter, when the first player had effected a certain number of downloads by other players, one or more promotional benefit(s) and advantage(s) would be awarded to said first player. The value of such promotional benefit(s) and advantage(s) could increase at pre-determined levels of download activity. Such links or URLs may be provided by any available means, including but not limited to e-mail, SMS messages, social media posting(s), and the like.

In some embodiments, promotional awards including but not limited to promotional benefits and advantages may be awarded to game proponents based on either the promotional activity or the game play activity of the users to whom promotional activities have been directed. Such activity may be based on any combination of activity involving non-wagering PED games, wager-based EGM games, or both. Game play activity may be determined via one or more counters within such games that register the number of times a game has been played, the duration of such play, the number or desirability of any benefit(s) and advantage(s) awarded during play, the results achieved during game play, data on any other game play activity, or any combination of the above. Such data may be either attributable to the specific device or identity of the player or it may anonymized and aggregated without attribution to a specific PED or player. The non-wagering PED games and the wager-based EGM games may periodically report the counter data to a central server with promotional benefit(s) and advantage(s) subsequently awarded to the player proponent responsible for introducing the game to the players whose activities have been reported. This method has the advantage of providing promotional benefit(s) and advantage(s) to players whose promotional activities have resulted in the greatest actual play of the games and not just for encouraging downloads that may not result in significant play.

Notwithstanding the examples above and without limitation, any other criteria may be utilized for determination of the awarding of promotional benefit(s) and advantage(s).

In some embodiments, promotional benefit(s) and advantage(s) may be awarded to referring players not only based on the promotional and game play activity of players to whom they directly promote either or both of the corresponding game, but also based on the promotional activities and game play activities of players introduced to the game(s) by said referring players. In effect, this creates a plurality of tree-like structures below each corresponding game proponent with a widening base as new levels of users are referred by proponents of the original player as well as the respective referee's own proponents, each creating their own tree of lower-level proponents. This model is similar but not identical to that of known multi-level marketing ("MLM") schemes whereby a participant earns credit for his own activity, a smaller credit for second-tier activities of his first-tier contacts, an even smaller credit for third tier activities of those second-tier contacts, and so on. However, unlike simple compensation paid in cash, credits, or other forms of direct remuneration, the promotional benefit(s) and advantage(s) awarded under the disclosed invention provide additional enhancements to the second game play state via transformation of a non-wager PED game, a wager-based EGM game, or both. Unlike MLM schemes in which a reduction of compensation for second, third, and lower levels of activities must necessarily be reduced below those of first level activities so that the awards do not exceed the cost of the item or service being marketed, awarding promotional benefit(s) and advantage(s) in corresponding games has no such practical limit. While the enhancements provided in the second game play state will generally make said second game play state more favorable to the player(s), other aspects of the wager-based EGM games may be adjusted to compensate for such the enhancements. As non-limiting examples, volatility of a wager-based EGM game may be adjusted when other benefit(s) and advantage(s) drive the profitability of the game below a desired level, or the enhanced play of wager-based EGM games may be limited to certain off-peak periods at gaming establishments that would provide the greatest benefit to gaming operators, or the available times during which a highly transformed wager-based EGM game may be played is limited to certain periods or for certain brief durations, or a portion of the second game play state enhancements may be awarded as benefit(s) and advantage(s) not related to the payout of wager-based EGM games, any combination of the above, or any similar accommodations. Therefore, in some embodiments of the invention, promotional benefit(s) and advantage(s) awarded to proponents for second, third, and lower levels of promotional activities may be maintained at the same level as those awarded for first level promotional activities without limitation.

In some embodiments, a player proponent may assign one or more benefit(s) or advantage(s) earned via game play of the non-wagering PED game to every player in his promotional tree defined by his own direct referrals and any referrals they subsequently make, without limitation.

In some embodiments, a corresponding game method proponent who achieves a certain level of promotional activity via any means or according to any criteria may be awarded the opportunity to modify the non-wagering PED game from a first game play state to an alternative first game play state of his preference. Such alternative first game play state may comprise enhancements to any existing features of the first game play state, enhancements via addition of new features not present in the first game play state, or the modification or deletion of any existing features or other aspects of the first game play state that may be made available for this purpose by the game developer or other enabling party on their own volition or at the suggestion of the proponent. By example and without limitation, the nature of said additional features may comprise different color schemes, higher resolution, alternative control means such as PED orientation or movement, any of the other game enhancements disclosed or envisioned herein with respect to enhancements available via benefit(s) and advantage(s). Features that may be deleted from the first game play state to create the alternate first game play state include, by example and without limitation, any such features that would increase the complexity of the game and increase the degree of skill required for successful play. Once created, the alternative first game play state can be made available to those in the proponent's tree of other players to whom he and they have promoted the electronic game(s) for their own benefit. This method effectively encourages evolution of the original game based on direct user participation and inures to the benefit of both the players and the game developers via the feedback and field testing received from users. As with the transformation of non-wagering PED games and wager-based EGM games from a first game play state to a second game play state via benefit(s) and advantage(s) earned during play of the non-wagering PED game and via promotional activities, the same degree of transformation from a alternative first game play state to a second (enhanced) game play state may be achieved via benefit(s) and advantage(s) earned during play of the non-wagering PED game, via promotional activities, or both. A person skilled in the art will recognize that the transformation possibilities are endless and are only limited by the imagination and creativity of the game designers and the players whose promotional activities rise to the level at which such player-inspired transformations are made available.

In some embodiments, the first game play state, the alternative first game play state, the second game play state, or any combination thereof may comprise community-based game(s) wherein two or more players may interact during play of the either or both of the corresponding games. In other words, the original game may provide, or any of the benefit(s) and advantage(s) accrued during play of the non-wagering PED game or via promotional activities may transform, either or both of the corresponding games from a single-player game into a game in which players may interact cooperatively (multiple players working toward a mutual goal), competitively (multiple players with divergent goals), or some combination thereof (multiple groups of multiple cooperative players in competition with each other). In this manner, a single player game may evolve over time into a highly transformed state based on game play, promotional activity, or some combination of both.

In some embodiments, benefits or advantages in the play of either version of a corresponding game may be provided to one or more present or potential gaming patrons by the hardware manufacturer, game developer, or other party-in-interest of said game, by the operator of the casino gaming establishment, or by any other interested party for the purposes of promotion, loyalty reward, or for any other desired purpose. Providing such advantage to a new or prospective user may be used to increase participation in the corresponding games.

In some embodiments, a PED game communicates with one or more servers via one or more of the communication protocols enabled in the host PED for the purpose of user identification, user or device authentication, executing the game, retrieving executable code, sending or receiving security-related information, animation, or images, sending or retrieving player or game status information, such as benefits or advantages earned by or to be provided to the user, or for any other useful purpose.

With the increasing popularity of server-based gaming, most modern EGM games at gaming establishments are configured to communicate with one or more servers via one or more communication protocols enabled in the EGM for a variety of purposes, including but not limited to user authentication services, transfer of game content or images, processing cashless gaming tickets, transferring gaming outcomes, and the like. Such communications are restricted to servers or other resources operative within a secured gaming network and communications are not permitted with any external servers or external resources.

In some embodiments of this invention, EGM games corresponding to PED games may also require sending or retrieving player or game status information, including but not limited to benefits or advantages earned by or to be provided to the user, or other data useful for any other purpose, to one or more third party servers. Such communications may be enabled via the existing secure networks administered by the gaming establishment operator in certain embodiments, where permissible. In some embodiments, communications between the existing secure networks administered by the gaming establishment operator and third party servers may not be permitted or even feasible.

In some embodiments, certain EGMs may not comprise any existing network capability due to the lack of infrastructure at the point of operation, incompatibility between the legacy capability of older EGMs and the requirements of secure modern networking systems, or for any of a myriad of other reasons. In such embodiments, the system of this invention may comprise additional hardware, firmware, and software capability to provide the necessary communication means to perform any necessary or desired data transmission to and from external servers beyond the periphery of the operator's secured network or otherwise inaccessible to the EGM. Such communication means may comprise any structure necessary to securely provide network access via any of the wired or wireless methods or protocols described herein or any that may be subsequently developed.

In some embodiments, a PED comprises one or more communication port(s) and is configured to communicate directly with an EGM configured to execute a corresponding game for the purpose of providing or receiving identification or authentication information, executing the game, sending or retrieving executable code, sending or receiving security-related information, animation, or images, sending or retrieving player or game status information, such as benefits or advantages earned by or to be provided to the user, or for any other useful purpose. Such communications are generally limited to short range communications in the case where a player of a PED game seeks to play the corresponding game on an EGM and utilize any benefits or advantages earned via play of the PED game. The player in this case will be in possession of a PED while proximate to a particular EGM selected by the player, so the necessary communication range will generally be measured in inches. Suitable means for such communications include at least one of any of Bluetooth®, NFC, ZigBee®, Wi-Fi®, Wi-Fi® Direct, other wireless means, BUMP technology, exchange of image information via bar codes, QR codes, or any other visual images, infrared optical transmission, audio transmission and reception, or the like. Said PED and EGM each comprise one or more communication port(s) suitably configured to provide bidirectional communication path(s) utilizing any of these or other preferred communication protocols. More than one of these technologies may be deployed in combination as desired to provide the optimal means for authentication and subsequent data transfer purposes via this proximate direct communications link.

In some embodiments, the mobile app comprising the PED game is configured to provide communication functionality enabling communication between the PED and the EGM. Additional code may be provided in the mobile app to access various hardware capabilities of the PED for the purpose of initiating and providing communication between the devices to perform any necessary function, including but not limited to authentication, data exchange, and any other useful function(s).

In some embodiments, particularly when communication from the EGM to any external server(s) necessary or desirable for proper execution of the corresponding games is unavailable for any reason, any communication necessary between the EGM game and any servers external to the secure casino network may be configured to pass from the EGM to the PED via the proximate direct communication link and then from the PED to the external server(s). Similarly, data or other information from said external server(s) may be conveyed to the EGM game via the PED's external communication means and then via the proximate direct communication link to the EGM. In this embodiment, no direct network access is required from the EGM to any server(s) external to the secured casino network via that secured casino network. This embodiment is also particularly well suited for use with EGMs lacking any network capability since all of the communications from the PED and the EGM are routed via the PED's external communication link(s) to any external server(s).

In the embodiments just described, the mobile app or a separate program or application may comprise additional code operative to convey data and other communications between the EGM and any external server(s). Said communications would require use of the proximate direct communication link between the PED and the EGM as well as the communication path between the PED and the remote servers. In this embodiment, the mobile app running on the PED would effectively function as a router for communication purposes in addition to its other functions as a personal electronic device. Using the hardware and other resources present in the PED, the mobile app comprising a PED game may additionally route data to and from the EGM as may be necessary or desired for proper execution of the EGM game corresponding to said PED game.

In some embodiments of the systems, the mobile app executing on user's PED is configured to initiate, control, and manage communications between the PED and the EGM. Normally, in a regulated casino environment, control of wager-based games is the exclusive domain of EGMs and any servers or other highly secured devices in communication therewith. However, for reasons described elsewhere herein, some embodiments of Applicant's invention may be configured such that the EGM maintains sufficient control of the wager-based EGM game to satisfy regulatory requirements while the PED is configured to provide certain administrative functions not related to the regulated EGM or the game operating thereon. For example, and without limitation or exclusion, in some embodiments the PED may perform functions such as initiating communication between the PED and an EGM selected by the player for the purpose of transferring benefits and advantages from one platform to the other, or to permit the EGM to access any third party server(s) upon which such information may be stored via one or more of the PED's available communication paths discussed elsewhere herein. In such embodiments, communication between the EGM and the PED would be completely isolated from any hardware, firmware, or software subject to regulation or other critical security issues and would essentially function as nothing more than an external input device, such as a button, touchscreen, or keypad, provided to a user for the purpose of entering data.

By way of example and not limitation, implementations of these and other embodiments of the invention may include one or more of the features described elsewhere herein. These and other features and advantages of this invention will be more readily understood from the following detailed description of the various aspects of the invention.

BRIEF DESCRIPTION OF THE DRAWINGS

Without limiting the invention to the features and embodiments depicted, certain aspects this disclosure, including the preferred embodiment, are described in association with the appended figures in which.

Figure 1A:
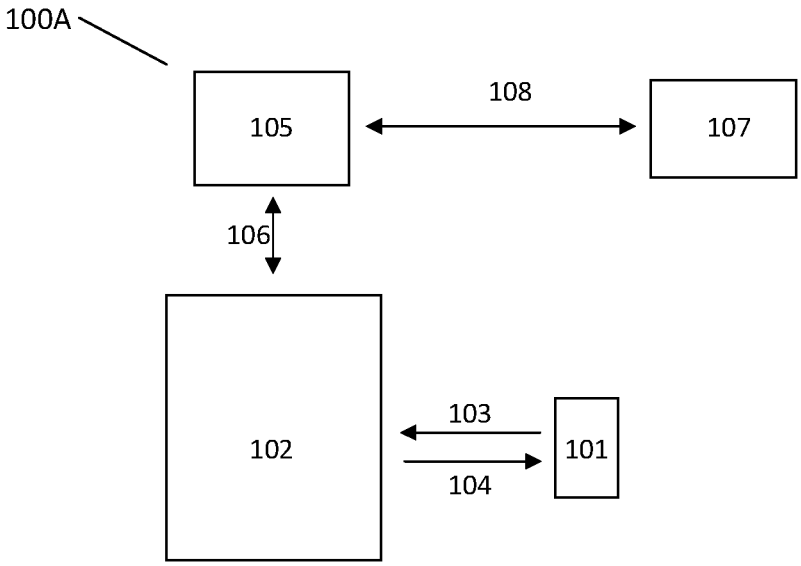
FIG. 1A is a block diagram of one embodiment of the system depicting bidirectional communication paths between a portion of the system elements wherein a PED is confined to communicate only with an EGM via one or more bidirectional path(s).

It should be noted that the drawings of the invention are not to scale. The drawings are merely generalized representations and are not intended to portray all specific parameters of the invention or create any limitations on particular embodiments. The drawings are intended to depict only certain embodiments of the invention, and therefore should not be considered as limiting the scope of the invention. In the drawings, like numbering represents like elements among the drawings. In other words, for the sake of clarity and brevity, like elements and components of each embodiment bear the same designations throughout the description. The presence of an alphabetic character in an element designator denotes a unique variation of a previously-presented element. For example, the system designated as 100B is a variation of previously presented system 100A, and so on. This permits the use of a unique element descriptor for each unique element while maintaining a consistent and comprehensible depiction of the various elements presented. In each embodiment depicted in the drawings, not every element or communication path depicted in the drawing may be required for the execution of every function of that particular embodiment. The presence of an element or communication path should be regarded as permissive rather than required; that is, such element or communication may be utilized where depicted, but given a plethora of options and flexibility available in any one embodiment, equivalent operation of said embodiment may be achieved in some cases without the need to utilize every element depicted. This degree of flexibility will become apparent as certain embodiments of the invention are disclosed in detail below.

DETAILED DESCRIPTION

Applicants' invention comprises systems and methods that permit similar or corresponding electronic games to be offered on multiple platforms, particularly on personal electronic devices (PEDs) and electronic gaming machines (EGMs), where benefits and advantages may be accrued by a player during play on one device or platform and said benefits and advantages subsequently transferred from game play from that device or platform to another device or platform. In a preferred embodiment, benefits and advantages earned via game play on a PED mobile application may be applied to play of a corresponding game on a wager-based EGM located within, or remotely administered by, a licensed gaming operator.

To provide for seamless and secure association of benefits earner on one platform to another, a plurality of specially designed and configured hardware devices are required to establish and enable communications between said PED(s) and EGM(s), provide operational control of said PED(s) and EGM(s), and secure the operation and interaction of said PED(s) and EGM(s) in compliance with applicable regulations and requirements for operation of wager-based EGM(s) in a casino or other authorized gaming environment.

Games executed on different devices or platforms are said to be "corresponding games" when they comprise some measure of commonality. This definition of corresponding games is intended to be very broad and encompassing. The ability to utilize any benefit or advantage earned via play of a game to other play of any game is one measure of commonality that characterizes corresponding games. For avoidance of any doubt, any game which is configured to utilize any benefits or advantages earned during play of that same game comprises a corresponding game with respect to itself by virtue of its ability to utilize the earned benefits and advantages. However, corresponding games will generally not be identical in many embodiments for a myriad of reasons, including the fact that games executing on different hardware and software platforms will not comprise equivalent hardware or software resources. Further, in some preferred embodiments, one significant improvement over known game methods provided by the corresponding game system is that certain games may be designed to provide somewhat similar but uniquely varied gaming experiences to users on different platforms or devices. Play of identical game(s) on multiple platforms will not enhance the user's gaming experience to the same degree as will the escalation, challenge of advancement, and discovery of new game play opportunities embodied in corresponding games related to some degree but not identical. The fact that corresponding games are not identical in some embodiments but are still cooperatively associated is one novel element of the inventive systems and methods.

As previously disclosed, corresponding games may also include a common characteristics such as theme(s), graphic presentation(s), character(s), element(s), or the like. While direct and obvious commonality between corresponding games is certainly included within the scope of this disclosure, the full scope of what may be considered to be "corresponding" is much broader. It is not necessary that corresponding games be similar in nature or that they even be directed toward the same objective, but only that there be some measure of commonality or any other relationship between them that may be discerned, understood, or appreciated by a player. As non-limiting examples intended only to illustrate the broad scope of this definition, one game may be directed toward the collection of objects while the corresponding game is directed to the distribution of those previously-collected objects in a prescribed manner. One game may involve the creation of a tangible object, such as a structure, while the corresponding game may be directed toward its destruction. Certain corresponding games may be linked by a benefit or advantage that does not pertain to the game in which it was earned and may only be applied toward the play of a second game. For example, a first game with a physical fitness theme (the player successfully collecting necessary items and completing certain exercise activities while subjected to numerous obstacles) may accrue strength and endurance by virtue of those activities that may only be applied to the play a second game simulating a sporting activity, such as the user's character in a multi-player football game. A reward earned in play of one game, such as magic beans, that may be transferred and applied to the play of another game, even one with wholly unrelated objective(s), theme(s), or character(s), would be a measure of commonality sufficient for those games to be classified as "corresponding games" as would any other similar connection or relationship, most notably the ability of a game to use any benefit or advantage earned from previous game play.

While preferred embodiments of this invention are generally directed to corresponding games executing on different platforms, a person of ordinary skill in the art will immediately recognize that corresponding games may also be provided on a single device or platform and that there is no requirement or limitation that such games be offered on different devices or platforms. For example, earned or awarded benefits and advantages may be transferred from a first EGM game to a second EGM game in the same manner as when such transfer occurs between a game executing on a first platform and a game executing on a second platform. The same is true with respect to a first game on a first PED and a second corresponding game on the same PED; any accrued benefits earned via play of the first game may be applied to the play of the second corresponding game. Accordingly, the scope of this disclosure explicitly includes the transfer of benefits and advantages from any first game to the play of any second game, whether or not the first and second games are played on the same device, different devices comprising the same platform, or different devices comprising different platforms. The essential characteristic of transferability between different games is that benefits and advantages may be transferred from a first game to a second corresponding game without limitation other than the games be configured to permit such transferability.

In some embodiments, a user plays a first electronic game on a first electronic device comprising certain platform, and in doing so, is provided with an opportunity to earn benefits and advantages that may inure to his advantage in playing said first game or one or more second corresponding games. In some embodiments, said first electronic game is executed on a PED. In some embodiments, said first electronic game is executed on an EGM. The game may be provided to the user without charge from any source, or the game may be purchased from a third party source including but not limited to iTunes®, Google Play®, a game developer's site, a casino operator's site, or the game may be provided by or obtained from any other source freely or in return for compensation.

Any benefits or advantages earned by the player during the play of said first electronic game on a first electronic device may be applied to the execution of that game, if such benefit or advantage is pertinent to said first game. A tabulation of said benefits or advantages may be recorded and stored on the platform providing the game to the player so that they may be easily recalled and applied during subsequent play of that first game, or a corresponding second game, on that same device. A record of said benefits or advantages, particularly those applicable to the play of a second corresponding game on a second device, may also be recorded and stored on the device providing the game to the player, stored on a remote server, an intermediate network device in communication with said first electronic device, or any combination of the above.

Records of stored benefits and advantages may be stored in any preferred form on a device, on one or more remote game servers, or both. Any form of alphanumeric or digital (binary, BCD, etc.) identifiers may be utilized to differentiate between each of the various individual benefits and advantages. Preferably, each possible benefit or advantage will be identified by a unique identifier so that they may be individually awarded and later applied. However, in some embodiments, a set of two or more individual benefits or advantages may be collectively associated with a unique identifier of its own so that the entire set may be awarded and applied as a group. This is particularly useful when a first benefit or advantage requires the simultaneous application of a second benefit or advantage to be operative and neither would be functional without the other, or when a user has been awarded numerous benefits and advantages that are more easily referenced collectively.

In some embodiments, record(s) of benefits and advantages will comprise a listing of the unique identifiers of each benefit or advantage, or groups thereof, stored in a convenient form to facilitate transfer from one device to another. Preferably, all such record(s) are encrypted so that users would be prevented from improperly modifying or even creating record(s) to their advantage. In some embodiments, record encryption may be performed using a key embedded in the game application itself. The key may be unique to the user or the device so that the record is unmistakably associated with that particular user or device and may be used as a component of user or device authentication. In some embodiments, an encryption key may be provided to the game application from an external source, such as but not limited to a remote game server or other third party source. In some embodiments, the record(s) may be sequentially encrypted using different keys from different sources or different keys intended to serve different purposes. In some embodiments, records may be signed using a private key associated with a particular user or device for security or authentication purposes. In some embodiments, a hash of the record(s) may be computed by the game application or another application and transmitted to a separate device, such as a remote game server or other repository, for use during validation of benefits and advantages when they are sought to be applied to play of a corresponding game. A person of ordinary skill in the art will recognize that many variations of these embodiments are envisioned by this disclosure. Simply by varying the source(s) of encryption key(s), the manner or order in which the record(s) are encrypted, the manner in which a hash of said data may be computed, communicated, and stored, and the manner in which the record data is decrypted and a comparative hash is generated and validated, a considerable set of alternative embodiments may be realized that all fall within the scope of this disclosure.

Before any benefits and advantages earned during play of a first game may be applied to a second game, the system must ascertain whether said first and second games are corresponding games. If so, and only if so, those benefits and advantages will be compatible. An important component of any record of accrued benefits and advantages is an identification of the first game within which said benefits and advantages were earned, designation(s) of any second game(s) deemed to be corresponding game(s) with respect to said first game, or both. Absent this information in some form, it will be impossible to properly associate benefits and advantages from said first game to said second game.

As with the format of the stored benefit and advantage records, identification of the first or second corresponding games may be provided in any form of alphanumeric or digital (binary, BCD, etc.) data sufficient to properly categorize said games. In one embodiment, identification of the first game is embedded in the unique identifier of each earned benefit and advantage or group thereof. At this most granular level, every benefit and advantage earned by a player may be independently identified by both the originating game and the specific benefit or advantage. In one embodiment, the format of the record is modified to reflect the identification of the originating game with no additional data added to the record. For example, certain families of corresponding games may generate benefit and advantage records with unique record lengths, or with certain character limitations (inclusion or exclusion), reserved placements, or the like. For example, certain alphanumeric characters may be reserved for certain families of corresponding games. In some embodiments, records created by each family of corresponding games may be encrypted with a key unique to that family of corresponding games so that any particular game may only successfully decrypt the benefit and advantages record of a corresponding game.

Benefits and advantages may be awarded during game play according to any criteria, such as but not limited to performing a certain action, achieving a certain number of points, attaining a certain goal or objective, playing for a certain duration, or any other criteria established by the game designer. As described elsewhere herein, certain preferred embodiments of the invention comprise the awarding of benefits and advantages to users that are generally viewed as positive in nature. That is, they are helpful to the users' efforts to "win" a game according to whatever may be defined as "winning" that particular game by providing a more favorable position with respect to successful performance. However, in some embodiments, certain benefits or advantages may alter the user's game play experience in a manner deemed to be neutral or at least slightly disadvantageous by the player, contrary to the conventional positive understanding of a "benefit" or "advantage". In some embodiments, the level of difficulty of a game may be increased to make the game more challenging, potentially with an opportunity to earn greater benefits and advantages. For example, the play of the game may be altered to increase the speed of play, possibly in conjunction with an opportunity to earn a greater number of points during the period of high-speed play. Another example of a benefit or advantage viewed as potentially disadvantageous by a player would be to replace one benefit or advantage highly desired by that particular player with a different benefit or advantage less desirable to that particular player but more highly valued by other players. In other words, not every benefit or advantage awarded during play of a game may be viewed as entirely positive by every player despite being categorized as a "benefit" or an "advantage". A benefit or advantage merely changes the nature of the user's game experience in some manner. However, preferred embodiments of this invention are directed toward encouraging users to accumulate benefits and advantages that enhance their overall gaming experience for the better, so the preponderance of benefits and advantages are intended to encourage users to expand their play and to utilize earned benefits and advantages on other devices, particularly EGMs in wager-based gaming environments.

Some benefits or advantages may be expendable, such as an extra life in a role-playing game or a token that may be swapped for another game play benefit. Once the expendable benefit or advantage is used by the player, the benefit or advantage is no longer available for use. Some benefits or advantages may be temporal; that is, they may provide a benefit or advantage to the player for a defined period of time or until a certain game event occurs, after which the benefit or advantage expires and is no longer operative. Some benefits or advantages may be persistent; that is, once conferred to the player, said benefit or advantage may continue to be operative for the player without expiration. Some benefits or advantages may become operative immediately upon award without the need for the player activation. Some benefits or advantages may remain available and be applied to game play upon the occurrence of a particular event, such as a shield that only becomes active when a player's character is subjected to a particular attack or other obstacle. Some benefits or advantages may remain available for activation by the player at a time of his choice. Some benefits and advantages may be operative, or be operative to a different extent, on different device(s) or platform(s). Any combination of the foregoing, or any other type or manner of applying a benefit or advantage to transform the play of an electronic game from one state to a different state, falls within the scope of this disclosure.

In some embodiments, and as previously disclosed, benefits or advantages obtained by a user during play of a first electronic game may not be applicable to the play of said first game but may only be applicable toward the play of a corresponding second game. Whether applicable to the game being played, a corresponding game, or both, benefits or advantages awarded to a player may be stored in the memory of the device executing the game, one or more remote servers in direct or indirect communication with said device, other networked communication devices in communication with either the device executing the game or a remote game server, or any combination of the above.

When a user who has accrued benefits or advantages via play of a first game wishes to play a second game corresponding to said first game on a second electronic device, any of said accrued benefits and advantages that may be applicable to the second game are transferred to the device on which the second game is to be executed from one or more stored location(s). As above, in some embodiments a record of the accrued benefits and advantages have been recorded and stored on the first electronic device. In some embodiments, a record of the accrued benefits and advantages have been recorded and stored on a remote device, including but not limited to a third party remote gaming server. In some embodiments, records of the accrued benefits and advantages may been recorded and stored in multiple locations and subsequently retrieved from any location available or desired. In some embodiments, a portion of the record may be stored in a first location and additional portion(s) of the record may be stored in one or more second location(s), thereby requiring each portion of the record to be retrieved and re-assembled to obtain the complete record. In some embodiments, entire records, or portions thereof, may be retrieved from multiple sources and used to verify consistency between the said records or portions thereof. In any of these embodiments, records pertaining to said benefits and advantages may be transferred from the first device to a remote location, from the remote location to the second electronic device, or both, via any one or more of the methods or communication paths described in detail below.

When any record of accrued benefits and advantages is stored on any electronic device, such record is preferably encrypted, encoded, or otherwise stored in a secure manner so as to prevent users from independently creating records of benefits and advantages not actually earned by game play. Any known or later developed method of data security may be employed to secure properly authorized records of benefits and advantages, including but not limited to PKI methods. In some embodiments, records of benefits and advantages may be stored in one or more locations and a secure hash of said records stored in one or more locations identical to or different from the locations where the records are stored. The hash of the authorized records may then be used to validate the authenticity of the records before any benefits and advantages are applied to play of the second game.

Once any accrued benefits or advantages are successfully transferred from a stored location to the second device, said benefits and advantages may be applied to the play of a corresponding game on said second device. As previously disclosed, benefits and advantages may be automatically applied or individually selected by the user as may be applicable for any particular benefit or advantage.

Benefits and advantages may also be accrued by the user during play of the corresponding second game on the second device. These benefits or advantages may be applicable to the play of the second game or any other corresponding game as defined elsewhere herein. Such benefits and advantages may be awarded, stored, transferred, and applied in a manner identical to that described herein for benefits and advantages awarded during play of the first game.

With reference to one embodiment of the invention depicted in FIG. 1A, electronic gaming system 100A comprises at least one personal electronic device ("PED") 101 capable of communicating with one or more electronic gaming device(s) EGM 102 via one or more bidirectional wired or wireless communication path(s) 103 and 104. Gaming system 100A may further comprise one or more gaming server(s) 105 in communication with EGM 102 and one or more remote game server(s) 107 necessarily or advantageously utilized in the management or execution of cooperative electronic games that are presented to users of PED 101 and EGM 102. Gaming device(s) 102, gaming server(s) 105, and remote game server(s) 107 are elements available in numerous other embodiments enabled by this disclosure and are described in detail below.

PED 101 may comprise any personal electronic device comprising hardware, firmware, and software as described in detail elsewhere herein that is capable of executing and presenting a game to a gaming patron and communicating via electronic means with one or more remotely disposed devices. Examples of PED 101 include, but are not limited to, computers, phones, tablets, phablets, electronic devices worn on the wrist (such as a smartwatches), personal digital assistants, or the like.

EGM 102 may comprise any preferred machine(s), device(s), or system(s), including but not limited to an electronic gaming machine, a game server, or any other electrical or electromechanical device capable of presenting a game to a user via one or more inputs and outputs and that is suitably configured for the purpose of sending and receiving information related to the operation of the system described herein. Any of the above terms, and others as well, may be used interchangeably to refer to the same element without deviating from the scope of this disclosure, but for consistency, gaming device 102 will generally be referred to as an EGM. EGM 102 may be administered by the PED manufacturer, the PED game developer, the operator of a gaming establishment in which a corresponding EGM game is operating, or by any third party designated and properly authorized to provide and administer said device(s). In some embodiments, EGM(s) 102 are protected within the network infrastructure of a secured gaming system administered by a licensed and regulated casino operator or the equivalent.

EGM(s) 102 may be any of the modern types of EGMs presently manufactured and sold by gaming hardware and system providers including, but not limited to, Aristocrat Technologies Australia Pty Ltd., Bally Technologies, Inc., WMS Gaming, and IGT Global Solutions Corporation.

In many embodiments, EGM 102 is associated and configured to communicate with one or more gaming server(s) 105 via one or more bidirectional network communication path(s) 106. Gaming server(s) 105 are typically protected within the same highly secured gaming system network infrastructure as are EGM(s) 102, whether or not EGM(s) 102 and gaming server(s) 105 are proximate or remotely disposed. Said network is usually administered by a licensed and regulated casino operator or the equivalent. Gaming server(s) 105 may provide hardware, firmware, software, and user authentication services, gaming outcomes, cashless instrument validation and issuance authorizations, executable code, paytable information, security-related data, animation, images, and promotional material to one or more EGM(s) 102, and possibly other gaming or related devices, operative within the highly secured gaming network infrastructure. In addition, gaming server(s) 105 may receive and log operational data from one or more EGM(s) 102 including but not limited to machine status, performance, meters, and the like. Communication protocols available or suitable for use with modern EGMs to communicate with gaming server(s) 105 via network communication path(s) 106 may include, but are not limited to, at least one of any of conventional wired TCP/IP connections, direct wired or wireless data connections, Wi-Fi® or any of the IEEE 802.11 standards, WiMAX or any of the IEEE 802.16 standards, Bluetooth®, NFC, or any other suitable known or later-developed standard or protocol.

Typically, within a regulated gaming environment, operation and administration of gaming server(s) 105 are the responsibility of the licensed operator responsible for securing all gaming operations on the premises where the servers are resident. In some embodiments, said operator may administer the server(s) of more than one licensed gaming establishment from a central facility via secure networking means, enabling management of gaming operations remotely. In either event, such networks are tightly controlled with severe restrictions placed on any remote connections to third party resources, such as the remote game server(s) 102 described above.

In some embodiments, EGM 102 is not in communication with any gaming server(s) 105. While server-based gaming continues to grow, EGMs incapable of communicating with gaming server(s) 105 are still in widespread use. As will be appreciated from the disclosure below, gaming server(s) 105 are neither preferred nor required for operation of the cooperative gaming system of this invention. While they may be accommodated, the system(s) of this invention are intentionally designed to provide full functionality even in the absence or unavailability of any communication between EGM 201 and gaming server(s) 105. The ability to retrofit older EGMs lacking access to gaming server(s) 105 via bidirectional communication path 106 with the functionality of the cooperative gaming system is a particular novel advantage of this system over the prior art.

One or more remote game server(s) 107 may be accessible to gaming server(s) 105 in the embodiment of system 100A via one or more bidirectional network communication path(s) 108 for the purposes of exchanging any information beneficial or essential to execution of a game as disclosed in detail below. Said communication path(s) 108 may comprise any preferred wired or wireless technology or protocol, including but not limited to at least one of any of a wired connection, such as but not limited to TCP/IP, a cellular, GSM®, CDMA, GPRS, EDGE, 3GPP, UMTS, 4G LTE, other wireless carrier communication protocol or standard, Wi-Fi® or any of the IEEE 802.11 standards, WiMAX or any of the IEEE 802.16 standards, Bluetooth®, NFC, or any other known or later-developed standard or protocol. Any of these technologies, protocols, or any subsequently developed may be utilized as preferred for any of the communications paths in this system as deemed suitable.

In some embodiments, remote game server(s) 107 are provided and administered by third parties, including but not limited to the developer(s) or administrator(s) of the cooperative games played on devices in communication therewith. In some embodiments, remote game server(s) 107 may be provided and administered by the operator of the licensed gaming establishment in which they are located or by any other duly authorized third party.

In some embodiments, remote game server(s) 107 may be accessible within the same secured gaming system network infrastructure as are EGM(s) 102 and gaming server(s) 105. In some embodiments, remote game server(s) 107 may be remotely disposed beyond the infrastructure of any secured gaming system and may therefore not be subject to the same degree of regulation as are servers located within said highly secured gaming network infrastructure. In either case, remote game server(s) 107 are fully secured and protected against unauthorized access or intrusion to secure all data and other content thereon.

In some embodiments, remote game server(s) 107 are configured to provide services, data, or other content essential to the proper operation of one or more PED game(s), one or more EGM game(s), or both. By way of several non-limiting examples, a user may be required to identify himself or authenticate with the game provider by exchanging certain identification or other data, tokens, or keys from said remote game server(s) 107 administered by the game provider prior to executing a PED game or an EGM. To provide for efficient execution of games on EGMs or on PEDs with limited memory, game content or images may be periodically downloaded from remote game server(s) 107 to EGM 102 or PED 101 via any available communication path described herein. As the user progresses through the game, his results may be communicated from PED 101 or EGM 102 to remote game server(s) 107 via any available communication path(s) for the purpose of recording and storing any benefits or advantages earned by the player. In these and other regards, remote game server(s) 107 may be essential to the proper operation of PED and EGM games.

When a PED game has a corresponding EGM game, said EGM game may also be dependent upon the same services, data, or other content essential to the proper operation of the corresponding PED game. Most notably, any benefits or advantages accrued by the player during play of the PED game must be retrieved by the EGM game from either PED 101 or remote game server(s) 107 in order to be applied to play of the EGM game. Accordingly, one or more communication path(s) between EGM 102 and remote game server(s) 107 may be beneficial or necessary for the proper operation of the corresponding EGM game. These are described in detail below with respect to different embodiments. One such path involves bidirectional network communication path(s) 106 and 108.

In some embodiments, short range communication path(s) 103 and 104 are provided between PED 101 and EGM 102. In the accompanying drawings, a pair of unidirectional communication paths (path 103 from PED 101 to EGM 102 and path 104 from EGM 102 to PED 101) are depicted because, in certain embodiments, different protocols or communication technologies may be utilized in each connection direction. As a non-limiting example, PED 101 may utilize near field communication ("NFC") technology to alert EGM 102 to its presence, thereby triggering EGM 102 to provide authentication or identification data to PED 101 via a protocol such as Bluetooth®.

In some embodiments, short range communication path(s) 103 and 104 may be combined into a single short range bidirectional communication path(s) (not shown) without any adverse effect on the system's operation. Any suitable communication means preferred for use with certain hardware, preferred for use in certain environments, or preferred for use under certain conditions may be employed to provide for the exchange of data between EGM 102 and PED 101 via short range communication path(s) 103 and 104 or their single bidirectional equivalent.

A principal concern of any communication path is providing adequate security of the hardware on both ends of the connection as well as the data flowing on said path. When data communication occurs in a wagering game environment, the level of security appropriate in less demanding circumstances is usually deemed inadequate to protect sensitive casino hardware and software from intrusion and unauthorized access. Highly sensitive financial transaction data comprising users' personal identification and account information may also be intercepted in transit between devices and used for illicit purposes. In all embodiments of Applicant's invention, all communication paths and associated ports are fully secured via the use of best practice security and encryption methods applicable to the particular task at hand, including but not limited to SSL, TLS, PKI, and the like.

Most EGMs do not presently comprise the specialized hardware necessary to provide short range communication path(s) 103 and 104 between EGM 102 and PED 101. Therefore, in some embodiments, the system includes one or more specialized machine(s) comprising hardware, firmware, and software capable of securely interfacing with EGM 102 and configuring said EGM for such communication. In some embodiments, a specialized communication interface machine provides additional means of data communication between EGM 102 and other elements of the various corresponding game system components that are independent of any other data communication capability present in the EGM. Such specialized communication interface machine may comprise any necessary or preferred combination of at least one of any of a case or other enclosure, one or more power supply(ies), one or more processors, one or more memories, one or more communication ports suitably configured to communicate via one or more communication protocols compatible with PED 101, one or more wired or wireless communication adapters, one or more antennas, and one or more outputs such as display(s), light(s), indicator(s), other illumination device(s), printer(s), printer port(s), or the like. Preferably, said specialized communication interface machine is securely disposed within the cabinet of EGM 102 and is in data communication with one or more systems of EGM 102 via one or more data communication protocols, including but not limited to USB, FireWire, TCP/IP, SATA, E-SATA, or other connection to a data bus utilized within the platform architecture of the EGM. The presence of this specialized communication interface machine is essential to the operation of the inventive system and represents an advancement over the present art of EGM design and operation. In some embodiments, a specialized communication interface machine may be implemented without the use of any processors or memories. For example, in one embodiment, the specialized communication interface machine may comprise only a simple radio frequency (RF) transmitter, receiver, and USB interface for the limited purpose of sending, receiving, and relaying data between PED 101 and one or more systems of EGM 102. Whether or not the specialized communication interface machine comprises hardware typically associated with "computing systems", such as processors and memories, it should not be construed in any manner as a conventional computing device as it is clearly not configured to perform, and is incapable of performing, the routine data manipulation tasks for which conventional computing devices have become ubiquitous. Instead, the specialized communication interface machine is a specifically selected combination of hardware components configured to perform only a limited subset of communication tasks as a necessary component of this system and therefore provides a well-accepted component that confers subject matter eligibility upon the system and methods disclosed herein.

Use of specialized communication interface machine(s) also facilitates the retrofitting of the inventive system with the multitude of EGMs currently deployed in gaming and other establishments worldwide. As the code for EGM games may be written in multiple forms compatible with the wide variety of platforms now available, development of new platforms to host the corresponding game methods taught and claimed herein will not be necessary. In some embodiments, the specialized communication interface machine may be configured as a device providing input to an EGM 102 in a manner nearly identical to hardware presently deployed, including but not limited to buttons, keyboards, touch screen displays, joysticks, or comparable devices, many of which communicate with one or more EGM systems via USB connection(s) and the associated USB protocol. This not only enables fast and reliable installation of the specialized communication interface machine but subjects that machine to all of the input device security protocols operative within the EGM. Input devices are effectively isolated from the execution of core gaming functions such as outcome determination, cashless ticket printing, and the like by intermediate EGM processing functions or through validation or verification of such a request by an outside sources such as a gaming server 105. In other words, EGMs are configured such that users are unable to cause an EGM to print a cash-equivalent ticket or generate a non-randomized outcome favorable to a player by simply providing a certain command to the EGM via one of its input devices. An input command comprising abnormal input received from the specialized communication interface machine will be trapped within the EGM's internal processes before it results in a security breach. This manner of connection of the specialized communication interface machine is merely one embodiment of this invention, and a person of ordinary skill in the art of EGM design and operation will immediately appreciate numerous other possibilities to provide secure data communication between the specialized communication interface machine and the EGM.

The system 100A as depicted in FIG. 1A may be used to provide one embodiment of the necessary communication paths to support the corresponding game play method described in detail herein. For example, a user having previously played a first electronic game on PED 101 will have accrued certain benefits and advantages during said play. A record of those benefits and advantages will have been previously stored in secure form in the memory of PED 101. When the user approaches EGM 102 to play a second game corresponding to the first game, communication between PED 101 and EGM 102 will be established via short range communication path(s) 103 and 104 to permit authentication between PED 101 and EGM 102 and the transfer of said benefits and advantages from the former to the latter. Said authentication and transfer of benefits and advantages may involve the transfer of certain data, including but limited to a user name and password, one or more keys, tokens, digital certificate information exchanges, hashes, encrypted or encoded data, or the like from or to remote game server(s) 107 via communication path(s) 103, 104, 106, and 108. Once the transfer is complete and any applicable benefits and advantages have been applied or made available for selection by the user, said user may play the second corresponding game on EGM 102.

During the play of the second corresponding game on EGM 102, certain data may be exchanged between the PED 101 and EGM 102 devices via communication path(s) 103 and 104. In this or any other embodiment, data exchanged between PED 101 and EGM 102 may comprise the retrieval of existing benefit or advantage record data stored on either device, new benefit or advantage record data being stored on either device, communication of output data such as video, audio, or haptic responses from a game currently being played on either device to the other device, input data supplied by a user, including but not limited to game play control functions or authentication information, from one device to the other, and so on. Following the initial exchange of benefit and advantage records preparatory to the play of the second corresponding game, communication path(s) 103 and 104 remain operative in some embodiments of the invention throughout the play of either game to provide a means for the exchange of any information necessary, beneficial, or desirable to the play of either of the corresponding games. This feature is not limited to the embodiment depicted in FIG. 1A but pertains to any of the embodiments described herein which comprise communication path(s) 103 and 104. In these and other embodiments, PED 101 comprises the central and controlling element in the cooperative game system.

However, in some embodiments, any of gaming server(s) 105 or bidirectional network communication path(s) 106 and 108 may not be available or practicable for the transfer of services, data, or other content between EGM 102 and remote game server(s) 107, or between PED 101 and remote game server(s) 107 via communication path(s) 103 and 104 and bidirectional network communication path(s) 106 and 108. As gaming server(s) 105, when present, are operative within a highly secured and regulated network infrastructure, such security and regulatory requirements may prohibit any communication whatsoever between gaming server(s) 105 and remote game server(s) 107 via bidirectional communication path(s) 108. Even in scenarios where such external communication paths may be established in compliance with all regulatory requirements, the operator or administrator of any gaming server(s) 105 within the highly secured gaming network infrastructure may refuse to provide such external communication for fear of compromising the security of the gaming network. When communication path(s) 108 are unavailable for any reason, communication path(s) 106 will not be sufficient for EGM 102 to communicate with remote game server(s) 107. In such embodiments, the player's benefits and advantages stored on remote game server(s) 107 may be communicated from said remote game server(s) 107 to EGM 102 via one or more wireless communication path(s) 109 and additional communication paths 103 and 104 as described below.

Figure 1B:
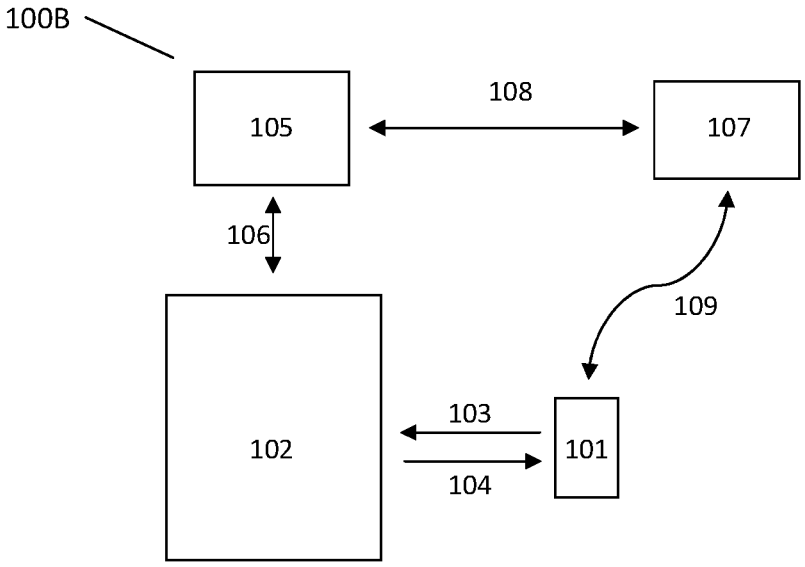
FIG. 1B is a block diagram of one embodiment of the system depicting bidirectional communication paths between a portion of the system elements wherein bidirectional communication path(s) are provided between a PED and one or more remote game server(s).

FIG. 1B depicts an embodiment of a system 100B which provides an alternate communication path between EGM 102, PED 101, and remote game server(s) 107. In some embodiments where a player of a PED game seeks to play a corresponding game on EGM 102 where said EGM has no access to the player's accrued benefits and advantages stored on remote game server(s) 107 via one or more bidirectional communication path(s) 106 and 108, or under any other circumstance where it may be desirable not to utilize those or any other communication paths within the purview of the secure gaming network, the cooperative gaming system may be configured to utilize one or more bidirectional wireless communication path(s) 109 via communication protocol(s) available to PED 101 in conjunction with communication path(s) 103 and 104 or their bidirectional equivalent. Communications between EGM 102 remote game server(s) 107 therefore pass through PED 101 as intermediate link. In such embodiments, PED 101 establishes at least one data communication path 109 to remote game server(s) 107 via any protocol available to the PED, including but not limited to any cellular or other mobile networks or via a WiFi® connection, though which PED 101 and remote game server(s) 107 may exchange data directly. Further, EGM 102 may also exchange data with remote game server(s) 107 via communication path(s) 103 and 104 to PED 101, which then relays any data received from EGM 102 to remote game server(s) 107 via wireless communication path(s) 109.

When it is necessary or desirable to provide secure data exchange between the EGM 102 and any remote game server(s) 107 where such data is desired or required to be isolated from and undiscoverable by PED 101 for any reason, such data may be encrypted and conveyed between the respective devices by any preferred tunneling means, including but not limited to a virtual private network (VPN) connection from end to end. Such techniques would prevent any data securely communicated from EGM 102 to remote game server(s) 107 from being intercepted or spoofed by PED 101 for nefarious purposes.

Figure 1C:
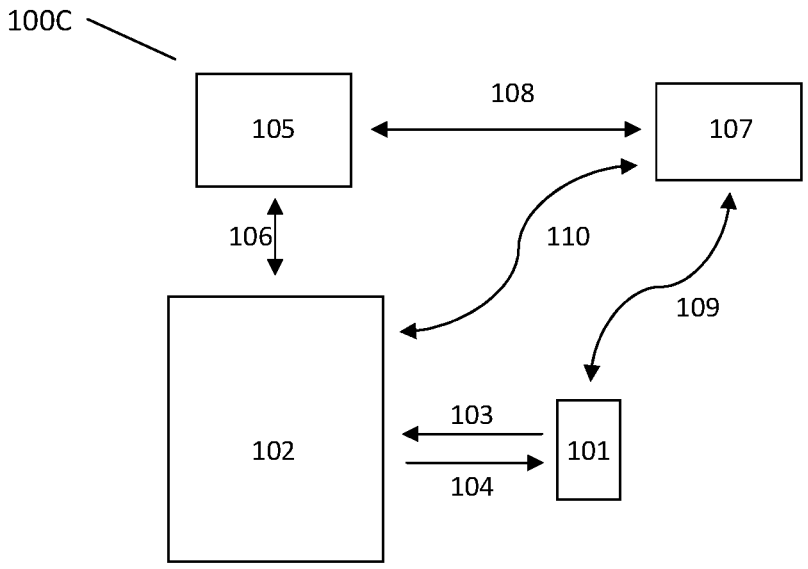
FIG. 1C is a block diagram of one embodiment of the system depicting bidirectional communication paths between a portion of the system elements wherein bidirectional communication path(s) are provided between a PED and one or more remote game server(s) and between an EGM and one or more remote game server(s).

System 100C depicted in FIG. 1C presents an additional embodiment of the invention with a modified communication configuration. Here, instead of using the wireless communication capability of PED 101 for data exchange between EGM 102 and remote game server(s) 107, the specialized communication interface machine provided to EGM 102 as a component of the inventive system further comprises a wireless interface configured to communicate directly with remote game server(s) 107 via bidirectional communication path 110 using any preferred means, including but not limited to any cellular or other mobile networks or via a WiFi® connection. In this embodiment, any necessary, desired, or beneficial data communications between EGM 102 and remote game server(s) 107 may utilize bidirectional communication path 110 while data communications between PED 101 and remote game server(s) 107 may continue to utilize bidirectional wireless communication path(s) 109. In the alternative, either PED 101 or EGM 102 may use either bidirectional wireless communication path 110 or bidirectional wireless communication path(s) 109, or both simultaneously, in conjunction with communication path(s) 103 and 104 where applicable, based on any preferred assessment of the several paths, such as speed or available bandwidth. The presence of multiple data communication paths to remote game server(s) 107 also provides a measure of fallback redundancy in the event of failure or temporary loss of either connection.

Figure 1D:
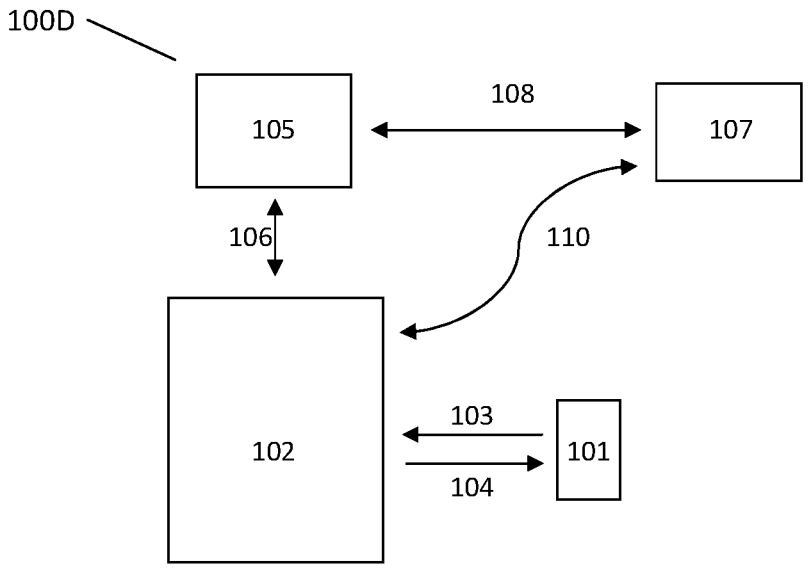
FIG. 1D is a block diagram of one embodiment of the system depicting bidirectional communication paths between a portion of the system elements wherein bidirectional communication path(s) are provided between an EGM and one or more remote game server(s).

FIG. 1D depicts the embodiment of system 100D wherein only EGM 102 maintains a bidirectional wireless communication path 110 to remote game server(s) 107. In this embodiment, data communications between PED 101 and said remote game server(s) 107 are first routed through communication path(s) 103 and 104 to EGM 102 and then to remote game server(s) 107 via bidirectional wireless communication path 110. The operation of the system in this embodiment is similar to that of system 100B of FIG. 1B except that bidirectional wireless communication path 110 is operative between EGM 102 and remote game server(s) 107 in lieu of bidirectional wireless communication path 109 associated with PED 101.

Figure 1E:
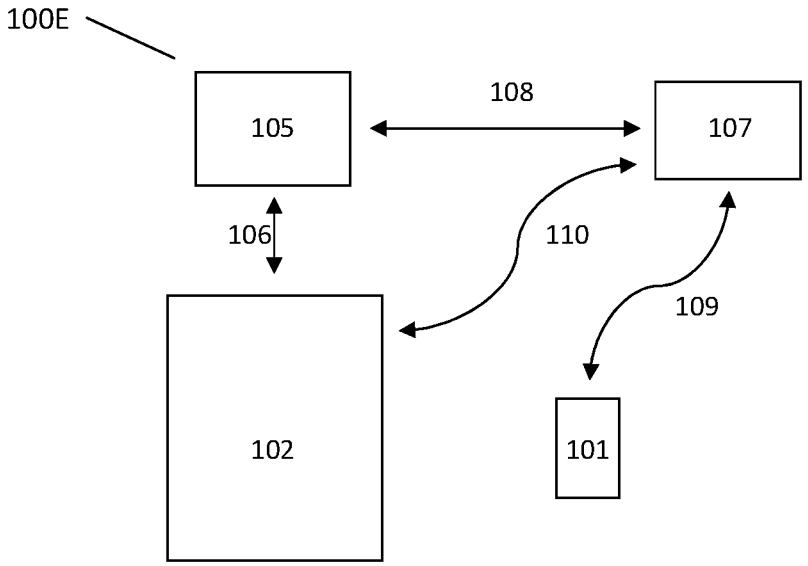
FIG. 1E is a block diagram of one embodiment of the system depicting communication paths between a portion of the system elements wherein bidirectional communication path(s) are provided between a PED and one or more remote game server(s) and between an EGM and one or more remote game server(s), but no direct communication path(s) are provided between said PED and said EGM.

Finally, FIG. 1E depicts an embodiment wherein system 100E comprises separate bidirectional wireless communication paths 109 and 110 between remote game server(s) 107 and PED 101 and EGM 102, respectively. This configuration provides an independent communication path between each device and remote game server(s) 107 without the need to route data to or from either device through the other device. However, the absence of communication path(s) 103 and 104 between PED 101 and EGM 102 require that all communications between those devices pass through remote game server(s) 107 via paths 109 and 110. This topology may be preferred in embodiments where particular games or other data exchanges must be continually monitored or arbitrated by remote game server(s) 107, or where a high degree of security is required that cannot be feasibly provided on communication path(s) 103 and 104. However, adverse effects due to the latency of data communications via cascaded links is thought to be problematic in some instances of real-time game play.

In some embodiments, the system of this invention may further comprise one or more intermediate wireless access point(s) (IWAP(s)) 201 disposed within or proximate to the gaming environment and configured to relay communications between PED 101, EGM 102, and remote game server(s) 107, from any originating device(s) to any destination device(s), along one or more bidirectional wireless communication path(s). Such intermediate wireless access point(s) 201 are preferably configured to receive and transmit wireless communications via any protocol described above but, in some embodiments, may additionally or alternatively employ alternate means including but not limited to wired communications means. Any such intermediate wireless access point(s) are also secured and protected against unauthorized physical or electronic access or intrusion.

Figure 2:
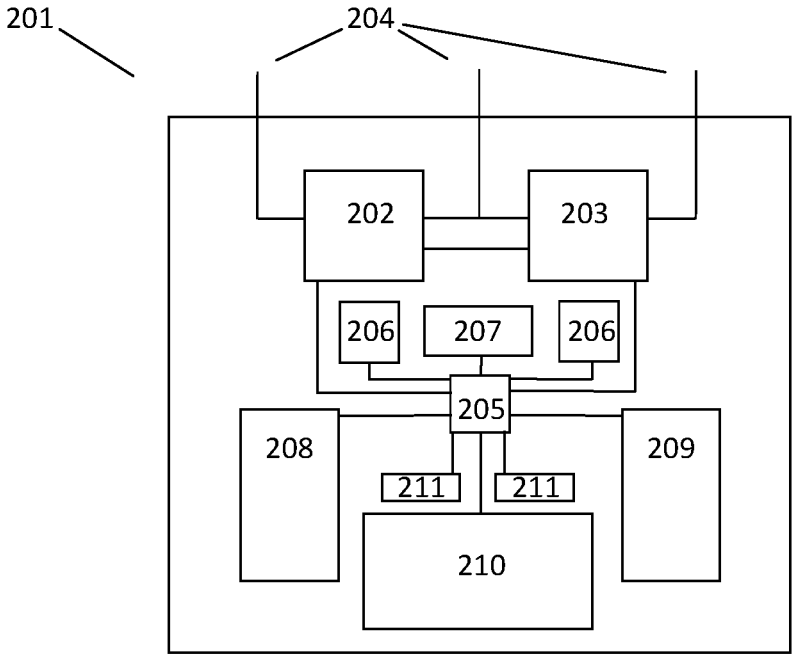
FIG. 2 is a block diagram of one embodiment of an intermediate wireless access point depicting various components utilized in certain embodiments of corresponding game systems.

One embodiment of said intermediate wireless access point(s) 201 is depicted in FIG. 2 and may comprise one or more wireless communication receiver(s) 202, one or more wireless communication transmitter(s) 203, one or more antenna(s) 204, and any other element(s), component(s), device(s), or capability necessary, beneficial, or desirable to enhance the performance of the corresponding game play system. For example, in addition the basic wireless functionality, intermediate wireless access point(s) 201 in some embodiments of this system may additionally comprise one or more processor(s) 205, one or more memories 206, persistent data storage 207 including but not limited to flash memory, magnetic storage, optical storage, and the like. IWAP 201 may also comprise one or more acceptance/reader devices 208 configured to receive cash, credit cards, smart cards, coupons, or other cash equivalents including cashless tickets for any useful purpose, including redemption or conversion functionality, e-commerce functionality including but not limited to dispensing computer or PED applications or other software product(s), dispensing tickets or coupons redeemable for cash, cash equivalents, or merchandise, or dispensing any other good(s) or service(s) suitable for e-commerce. IWAP 201 may also comprise one or more tangible medium output devices 209, including but not limited to any type of printer or other device configured to write data in printed, magnetic, optical, or stored memory form to any suitable tangible media for the purpose of providing receipts, tickets, coupons, cash equivalents including cashless gaming tickets, advertisements, administrative diagnostic information, or any other useful tangible item. IWAP 201 may also comprise one or more input or other output device(s) 210 and 211, each one capable of receiving input, providing output, or both, including but not limited to display(s), button(s), video-simulated buttons, switch(es), trackball(s), lever(s), dials, keyboard(s), touch screen display(s), lighting or indicators, audio input or output devices, haptic devices, signage, PED interface devices such as wired or wireless interfaces, including connection cradles or charging stations, or any similar devices configured for use by patrons or administrators of the device. IWAP 201 may also comprise one or more cameras and may additionally comprise any other element(s), component(s), or system(s) that provide additional functionality. It should be understood that a single element in IWAP 201 may serve multiple purposes, such as a touch screen display functioning as both a visual output device and a user input device, a single electromechanical machine capable of both receiving cash in paper form and providing output in the form of a printed receipt, or a button that also comprises a small display thereupon via the use of LEDs, OLEDs, or an LCD screen, and the like. Further, IWAP 201 may comprise any combination of elements in any number or configuration useful for its intended purpose(s).

In some embodiments, intermediate wireless access point(s) may be installed in such a manner as to be physically inaccessible to users of the corresponding game play system and only accessible via wireless communication paths, as are most other public wireless access points. In these embodiments, all of the functions useful to users may be accessed wirelessly.

In some embodiments where said intermediate wireless access point(s) comprise additional element(s) as described above, they may be provided in the form of a kiosk physically accessible to users to provide functionality beyond the relaying of wireless data communications. For example, IWAP 201 may be configured to provide a menu of downloadable corresponding game or other electronic device applications for users to purchase, accept cash, a cash equivalent, or read account information from a user's credit card as payment, and provide a printed receipt to the user following such a transaction. A user seeking to play an EGM game corresponding to a PED game on which benefits and advantages have been accrued may desire, or be required to, authenticate his identity, the PED 101 on which said benefits and advantages were previously earned, or both at an accessible kiosk-style IWAP 201 in person before the benefits and advantages may be transferred to the EGM game.

Throughout this disclosure, the acronym "IWAP" will be used to refer to any embodiment of an intermediate wireless access point 201 comprising wireless communication capability accessible to at least one of any of one or more PED(s) 101, EGM(s) 102, remote game server(s) 107, or gaming server(s) 105 whether or not said IWAP also comprises additional element(s), component(s), device(s), or functionality.

Figure 3A:
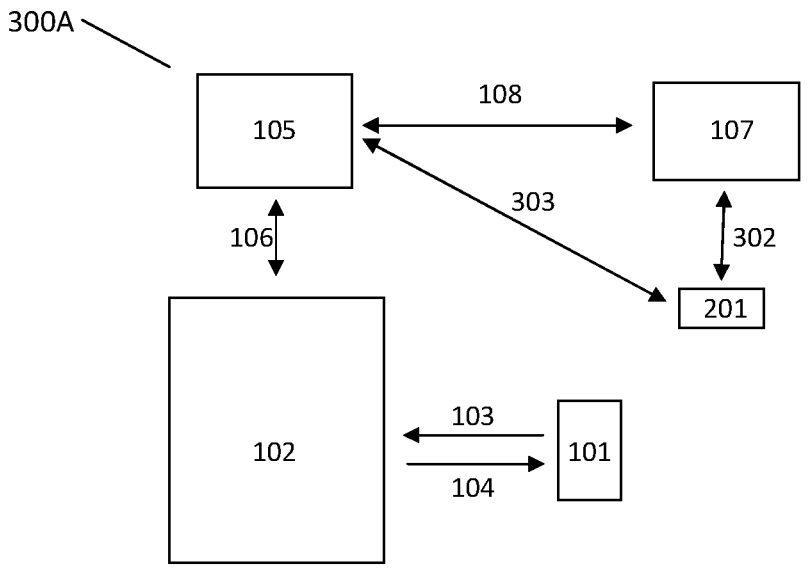
FIG. 3A is a block diagram of one embodiment of the system depicting bidirectional communication paths between a portion of the system elements, including an intermediate wireless access point with bidirectional communication path(s) to one or more gaming server(s) and one or more remote game server(s).

FIG. 3A depicts system 300A comprising the previously-described elements and communication paths of system 100A but additionally comprising IWAP 201. As shown, IWAP 201 is in data communication with remote game server(s) 107 via one or more bidirectional communication path(s) 302 and also in data communication with gaming server(s) 105 via one or more bidirectional communication path(s) 303. In some embodiments, bidirectional communication path(s) 302 are wireless communication path(s) utilizing any preferred protocol and bidirectional communication path(s) 303 are wired communication path(s), wireless communication path(s), or a combination of both, any of said paths utilizing any preferred protocol. This configuration provides an alternate communication path between gaming server(s) 105 and remote game server(s) 107 via IWAP 201 when security concerns prohibit direct data communications between gaming server(s) 105 and remote game server(s) 107 via the direct communication path(s) 108. IWAP 201 may be physically disposed proximate to gaming server(s) 105 and located within the same secured building, so this intermediate device may therefore be sufficiently trusted by the administrator(s) of the secure gaming network to serve as a communication link between gaming server(s) 105 and remote game server(s) 107.

Figure 3B:
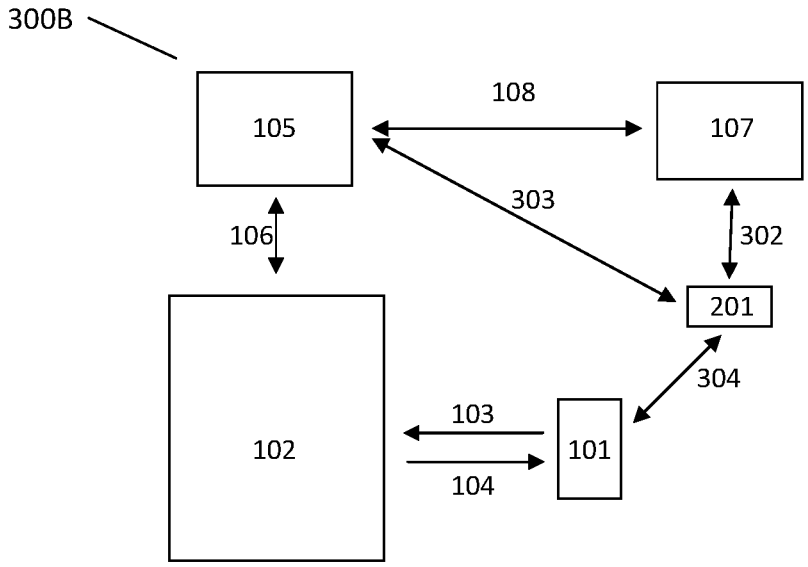
FIG. 3B is a block diagram of one embodiment of the system depicting bidirectional communication paths between a portion of the system elements, including an intermediate wireless access point with bidirectional communication path(s) to a PED, one or more gaming server(s), and one or more remote game server(s).

FIG. 3B depicts system 300B comprising all of the elements and communication paths of system 100B, IWAP 201 and communication path(s) 302 and 303 from system 300A, and one or more additional bidirectional communication path(s) 304 between PED 101 and IWAP 201. This configuration provides all of the advantages of both of the above systems with the additional advantage of permitting communications between PED 101 and remote game server(s) 107 via IWAP 201. As described previously, providing a communication path between PED 101 and remote game server(s) 107 (here, via communication path 304, IWAP 201, and communication path(s) 302) permits PED 101 to authenticate or to access game play data, accrued benefit and advantage records, and any other necessary, beneficial, or useful information on remote game server(s) 107 when communication path(s) 106 and 108 are not available for any reason. Additionally, as described earlier, EGM 102 may also communicate with remote game server(s) 107 (here, via communication path(s) 103 and 104, PED 101, communication path 304, IWAP 201, and communication path(s) 302) for any of the purposes described above or for any other beneficial purpose.

Figure 3C:
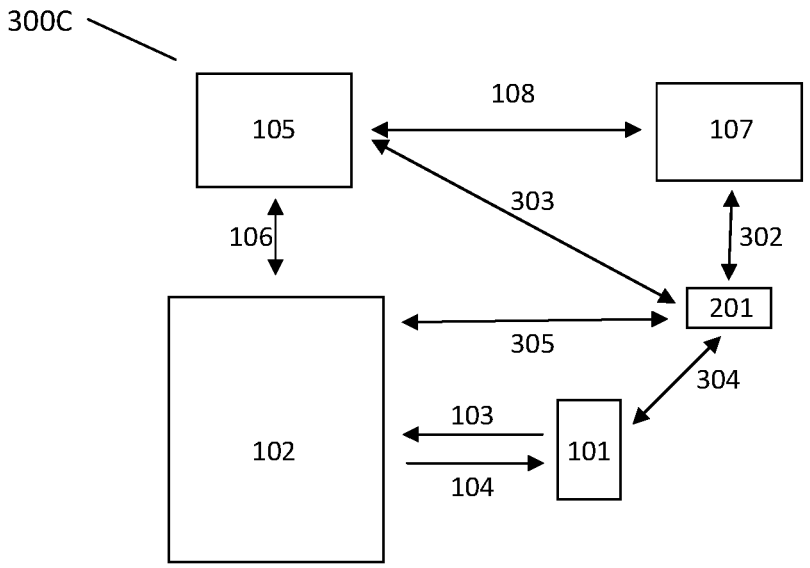
FIG. 3C is a block diagram of one embodiment of the system depicting bidirectional communication paths between a portion of the system elements, including an intermediate wireless access point with bidirectional communication path(s) to a PED, an EGM, one or more gaming server(s), and one or more remote game server(s).

FIG. 3C depicts system 300C comprising all of the elements and communication paths of system 300B and the previously-described related embodiment with the addition of one or more bidirectional communication path(s) 305 between EGM 102 and IWAP 201. Although communication path 305 may comprise any known or later-developed type of communication path, in preferred embodiments of this invention, communication path 305 may comprise a wireless communication path utilizing any preferred wireless communication protocol. As previously described with respect to system 100C, communication path 305 enables EGM 102 to communicate with remote game server(s) 107 independently of PED 101 and provides a measure of redundancy in the event other communication paths are unavailable during operation of the corresponding game system. As with all embodiments where a data communication path is prescribed between EGM 102 and any other element or component of the corresponding game system, the specialized communication interface machine described in detail elsewhere herein may also be provided as an element of the system in communication with EGM 102 for such communication purposes.

Figure 3D:
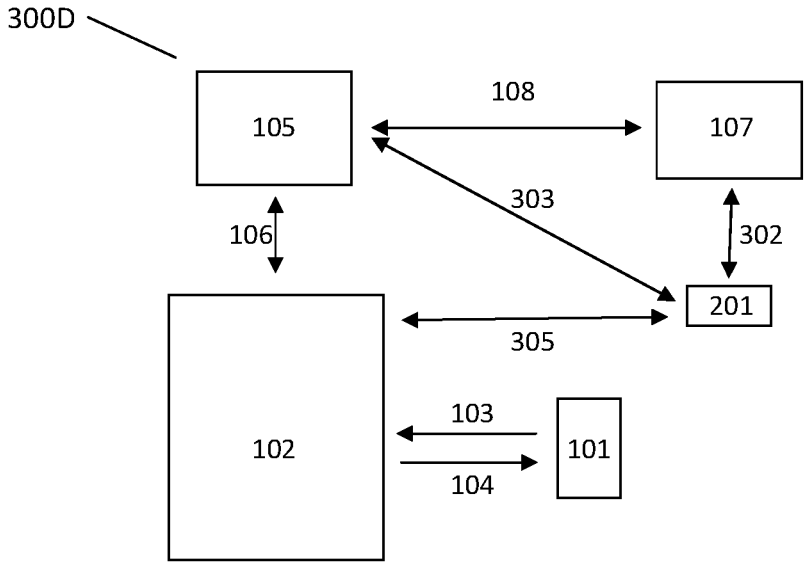
FIG. 3D is a block diagram of one embodiment of the system depicting bidirectional communication paths between a portion of the system elements, including an intermediate wireless access point with bidirectional communication path(s) to an EGM, one or more gaming server(s), and one or more remote game server(s).

System 300D, depicted in FIG. 3D, comprises all of the elements and communication paths of system 300C with the exception of communication path(s) 304 between PED 101 and IWAP 201. As described with respect to system 100D, any communication between PED 101 and remote game server(s) 107 would necessarily pass through one of the alternate routes, preferably via communication path(s) 103 and 104, EGM 102, communication path(s) 305, IWAP 201, and communication path(s) 302.

Figure 3E:
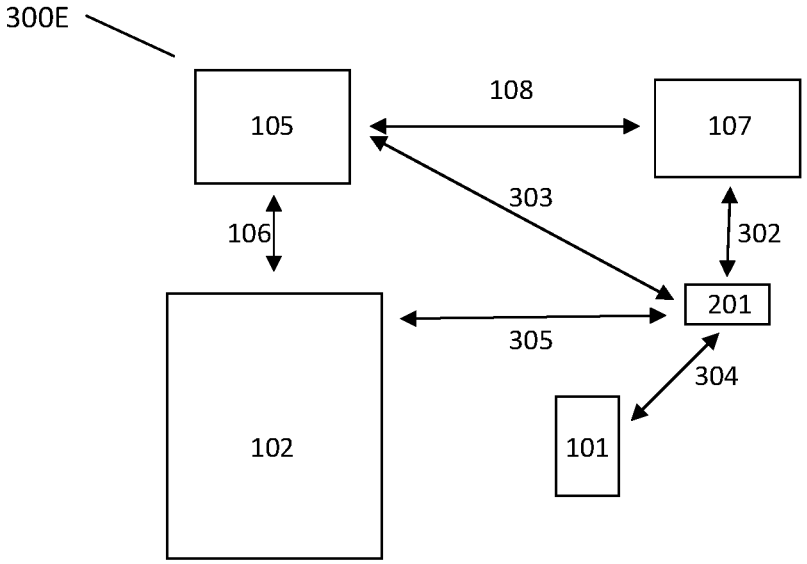
FIG. 3E is a block diagram of one embodiment of the system depicting bidirectional communication paths between a portion of the system elements, including an intermediate wireless access point with bidirectional communication path(s) to a PED, an EGM, one or more gaming server(s), and one or more remote game server(s), but no direct communication path(s) are provided between said PED and said EGM.

Finally, system 300E, depicted in FIG. 3E, comprises all of the elements and communication paths of system 300C with the exception of communication path(s) 103 and 104 between devices PED 101 and EGM 102. As described with respect to system 100E, PED 101 and EGM 102 each maintain an independent communication path to remote game server(s) 107 through which they may exchange data with each other without tunneling their data through the other device. Similar to the operation of system 100E, all data communication between PED 101 and EGM 102 must be routed through remote game server(s) 107 via communication paths 304 an 305 and IWAP 201. In some embodiments, PED 101 and EGM 102 may communicate using remote game server(s) 107 via communication paths 304 and 305 between IWAP 201 and communication path(s) 302 between IWAP 201 and remote game server(s) 107.

The depictions and descriptions of the embodiments of systems 100A-100E and 300A-300E are intended to illustrate the plethora of structure and configurations possible in a system required to execute the corresponding game method described herein. It should be understood that under certain circumstances and for certain applications, any one or more of these different embodiments may be suitable for the intended purpose. Further, the presence of any particular element(s) or communication path(s) in any of the depicted embodiments does not necessarily imply that said element(s) or communication path(s) are essential or preferred for any particular purpose. In many embodiments, the same results may be achieved through the use of certain element(s) or communication path(s) without the need to use other depicted element(s) or communication path(s). As one non-limiting example, when accrued benefit and advantage data is stored on PED 101 in a particular embodiment, it may not be necessary or desirable to retrieve said data from remote game server(s) 107. However, in some embodiments, retrieval of said data from both sources may be preferred to ensure that the latest data is retrieved for the benefit of the player, to confirm or validate that the retrieved data is consistent in both locations, or for other reasons. In other words, the elements and communication paths in each embodiment are to be viewed as enabling rather than limiting upon the scope of the invention. Further, a person of ordinary skill in the art will appreciate that the embodiments depicted and described above enable the use of numerous similar embodiments that fall within the scope of this disclosure, as portions of each of these embodiments may be combined to form other embodiments with similar functionality. All of these additional embodiments fall within the scope of the invention and this disclosure.

The IWAP-enabled embodiments described above, and other embodiments derived therefrom, provide opportunities for enhanced reliability, security, and functionality in support of the corresponding game systems and methods directly attributable to the IWAP. Due to electrical interference from the multitude of electronic and electromechanical devices operating in a modern casino floor, as well as the structure of the building(s) in which the casino is housed, PED access to mobile networks, including cellular networks, is often problematic. For this reason, many casino operators provide open wireless access points as a courtesy for the use of gaming patrons. This service is completely independent of the highly secured casino gaming network supporting EGM(s) 102, gaming server(s) 105, and other gaming devices and is usually unsecured with no encryption and with anonymous access enabled. For these reasons, unauthorized interception of patron's confidential information, including but not limited to logins and passwords sent to third party sites, is a trivial exercise even for relatively unskilled intruders. While device-to-device encryption via SSL or TLS provides some measure of security over open wireless links, not every server accessed via an open and unsecured wireless service provides the necessary infrastructure for a secure SSL or TLS link. Further, open wireless services may be insufficient for other reasons. With a large number of users accessing open services, such services may provide insufficient bandwidth for reliable operation of the corresponding game system and methods. Further, casino operators may not appreciate that the available bandwidth of their courtesy systems is being consumed by the operation of the corresponding game systems. For these and other reasons, a preferred embodiment of the invention comprises one or more IWAPs 201 provided exclusively for its own operation. Such service(s) are fully secured and are not subject to bandwidth limitations imposed by other services.

With respect to enhanced security, the transfer of accrued benefits and advantages from either a first device to a second device, or from remote game server(s) 107 to a second device, requires appropriate user or device authentication to ensure that the request for such transfer is tendered by the owner of those benefits and advantages. In some embodiments, it may be sufficient to authenticate only the user as the owner of said benefits and advantages. This may be accomplished by customary login/password or other challenge/response methods when either of the first or second devices are not the personal property of the user and may subsequently be utilized by someone else. In some embodiments, it may be preferred to authenticate one or more of the devices rather than, or possibly in addition to, the user, particularly when at least one device is the personal property of a user on which previous game play was completed and a record of accrued benefits and advantages is stored. In some embodiments, a principal objective of authentication is directed to ensuring that a first device, such as PED 101, in the possession of a user is properly associated with the correct second device, such as EGM 102, so that said user's benefits and advantages are transferred to the proper second device as intended by the user.

Authentication of users, devices, or both may be performed by PED 101, EGM 102, gaming server(s) 105, IWAPs 201, or by any combination thereof and accomplished by any known or later-developed method(s), including but not limited to the same conventional login/password or challenge/response methods ("something you know") useful for public devices, hard biometric methods ("something you are"), soft biometric methods ("something you do"), PKI methods, digital certificate methods, or the like. In some embodiments, authentication and transfer may be performed between PED 101 and EGM 102 when the benefit and advantage record information is stored on PED 101. However, when benefit and advantage record information is stored on remote game server(s) 107 and will be retrieved, any method of authentication will necessarily involve remote game server(s) 107 as well. Any authentication method deployed in the system must be sufficiently secure to safe guard users' data and other information, but in preferred embodiments of the invention, such authentication will also be minimally intrusive and maximally convenient to users so as not to be burdensome or a hindrance to their use of the corresponding game method.

IWAP 201 may be utilized to implement one or more novel authentication schemes. The descriptions provided below are non-limiting upon the scope of the invention and merely illustrative of numerous similar embodiments enabled by the versatility of the several corresponding game systems disclosed herein. Other embodiments will be immediately appreciated based on the following disclosure.

In some embodiments, devices PED 101 and EGM 102 may each communicate with IWAP 201 via any of the various communication paths described in the systems presented above to provide prompts and receive authentication or challenge responses from a user, procure and communicate a user's biometric data such as a fingerprint, facial, retinal, hand profile, or other scan, obtain and communicate behavioral data from a user, exchange keys, images, or other authentication tokens between devices, perform steps necessary to complete validation of one or more digital certificate(s), or to perform any other desired authentication process. To this end, PED 101, EGM 102, IWAP 201, or any combination thereof may comprise an input device configured to permit users to enter such data in response to an authentication request. Such devices may include, but are not limited to, keypad(s) with mechanical, electrical, capacitive, resistive, or other forms of buttons, simulated keypad(s) depicted on touchscreen device(s), touch sensitive pads responsive to the touch of a finger or a stylus to receive input from a user in written or drawn form, such as a signature, or any other input device known in the present art or that may be later developed and suitable for the intended purpose.

In some embodiments, all of the actual authentication steps are performed by devices PED 101, EGM 102, or both, and IWAP 201 only serves as an intermediate communication relay between said devices. In some embodiments, IWAP 201 comprises at least a portion of the additional computational elements and functionality described above, exchanges data with PED 101 and EGM 102, executes any computational process(es) necessary to complete the authentication, and provides the confirmation of authentication necessary for execution of the corresponding game method by both devices. For example, and without limitation, IWAP 201 may generate a pair of keys for PED 101 and EGM 102 (equivalent to the public and private key pair in known PKI methods) and transmit each key to the respective device so that they may complete the authentication process in the usual manner. In another embodiment, IWAP 201 may provide an image, such as but not limited to a bar, QR, or other code to a first device that may be captured or otherwise read by a second device for authentication purposes. In another embodiment, a first device may compute a hash of authentication data received from a second device and transmit said hash to IWAP 201 for verification. To any extent necessary, IWAP 201 may also provide confirmation of successful authentication of or between PED 101 and EGM 102 to remote game server(s) 107 so that any data, including but not limited to records of accrued benefits and advantages, may be retrieved from or stored on remote game server(s) 107 as necessary.

IWAP 201 may be utilized as an authentication server in some embodiments by, for example, receiving a request for authentication from either or both devices PED 101 and EGM 102, providing data to either or both devices required to be communicated to or processed by the other device in order to complete authentication, confirming the successful communication of said data between devices, and communicating said confirmation to both devices and remote game server(s) 107 as necessary. Additional communications between the various devices may be required or desired as well.

In some embodiments where IWAP 201 comprises one or more camera(s), a user or a device may be authenticated using image capture or transfer methods. For example, one or more image(s) of a player may be obtained by IWAP 201 from one or more perspectives and compared to previously-stored image(s) of the user. Facial or other recognition methods may then be applied using one or more characteristics, including but not limited to the ratio of overall facial dimensions, feature placement, eye color, iris pattern(s), hand shape(s) or hand feature characteristics, and the like. In some embodiments, one or more sequential images may be captured for the purpose of gesture recognition when compared to a previously-stored sequence of the same user performing a same gesture. Sequential gestures may be captured as single images or in such rapid succession as to collectively comprise a moving image, such as a video image. Any user images captured for authentication purposes may be stored, preferably but not exclusively in IWAP 201, for comparative use in future authentication of the user. This way, a body of images are available to increase both the reliability and speed of future authentications based on image comparison.

In some embodiments, an image or sequence of images displayed on a screen of a device such as PED 101 may be captured by a camera associated with IWAP 201 and compared to an expected version of the image(s) stored in IWAP 201 or obtained thereby from or via remote game server(s) 107. As a non-limiting example, a game executing on PED 101 may generate and store an image, such as a bar code, QR code, other code, or a special game image when the player of said game earns or otherwise receives a benefit or advantage. Such image may contain encoded information regarding the player's identity, data regarding the specific benefit or advantage awarded, information regarding the game under which the benefit or advantage was awarded, or any combination of the above along with any other pertinent information. When the player wishes to transfer said benefit or advantage, a camera associated with IWAP 201 or EGM 102 may capture the image recalled from memory and displayed on PED 101, decode the data represented in said image via IWAP 201 or remote game server(s) 107 if necessary or desired, and thereby authenticate the player, the device, the player's entitlement to receive the benefit or advantage represented by said image, or any combination thereof. This method is applicable to authentication and benefit and advantage validation together or separately in various embodiments of the invention.

In some embodiments, one or more authentication methods may be employed in combination, particularly in sequence, to provide persistent validation that an authenticated user has not been replaced by another user, either intentionally or inadvertently. This provides the advantage of protecting a user's account in the event the user inadvertently walks away from an EGM game without properly terminating the play session or in the event a third party actively interferes with the user's session. For example, a user may first authenticate himself, his device, or both at IWAP 201 prior to first play of an EGM game in a casino environment via any known method. Periodically thereafter, the user may be required to re-authenticate via any known method at EGM 102, IWAP 201, or PED 101 to ensure that the same user is still present and in control of the game play device(s) PED 101 and EGM 102. Such periodic re-authentication may be accomplished via active means, such as requiring the user to provide an affirmative response to a challenge or other request, or via passive means, such as capturing an image of said user and comparing it to a previous image without any active participation by the user or even any knowledge by the user that said re-authentication is occurring. Such active or passive re-authentication may also include any other known or later-developed methods, such as re-validating or updating one or more electronic keys, tokens, or digital certificates and may be performed via any communication path(s) available for such task. In some embodiments, a number of different communication path(s), potentially but not exclusively utilizing different communication protocols such as 4GLTE, GPRS, other cellular, WiFi®, Bluetooth®, NFC, ZigBee®, and the like, are intentionally used for various stages of authentication and re-authentication so to increase communication security. Intercepting and spoofing communications on a myriad of paths and with a myriad of protocols is immeasurably more difficult than if such communications were restricted to a single communication path and protocol. In these persistent embodiments, various devices described above work collectively to ensure that the desired level of user or device authentication is provided and maintained throughout the user's cooperative gaming session.

The scope of these descriptive authentication examples encompasses any embodiment where IWAP 201 arbitrates the authentication of either the user or devices PED 101, EGM 102, or both by communicating with any combination of devices PED 101, EGM 102, and remote game server(s) 107 so as to successfully complete a secure process enabling the corresponding game method of this invention to be provided to a user, regardless of the specific nature of the communications or their content.

In some embodiments, the mobile app is configured to cause the hardware in the PED to detect the presence of an EGM presenting a corresponding game and automatically initiate a communication path between the PED and the EGM for the purpose of authenticating the player and communicating any benefits and advantages between the two platforms. In some embodiments, the mobile app is configured to initiate and transfer the data without intervention from the player. In some embodiments, the mobile app requires active participation from the player, such as confirmation to connect to an EGM previously identified by the mobile app, before initiating any communication or data transfer between the platforms. In some embodiments, initiation of the communication path may only commence upon a direct command from the player, such as activating a function in the mobile app and identifying to the mobile app which EGM the player has selected for play.

In some embodiments, a first application running on a first device, such as PED 101, will automatically detect, or be detected by, the presence of a corresponding second application running on a second device, such as EGM 102, that is configured to provide a second game corresponding to a first game on which benefits and advantages have been previously accrued on said first device. Said first application may be the same application that provided the first game on the first device or it may be a separate application operative only to detect, or be detected by, the presence of devices configured to offer one or more second corresponding games. Each of the first and second applications may automatically detect the presence of the other application via periodic transmission of a wireless signal that, when received by another corresponding application, alerts a user to the proximity of a device configured to offer a corresponding game. The user may then optionally elect to play a corresponding game on the second device, continue to search for a different device offering corresponding game(s), or decline to play any corresponding games at that time.

Identification of each platform by the other may be performed in any number of ways. In some embodiments, the mobile app may seek to connect to the nearest EGM configured to offer the corresponding game based on criteria such as signal strength due to proximity. In some embodiments, commencement of play on an EGM may activate one or more short-range communication services, such as NFC or Bluetooth®, present in the EGM where such communication is subsequently received by the PED and passed to the mobile app for initiation of a communication link. In some embodiments, the player may indicate his desire to establish a communication link between a PED and an EGM using physical means including but not limited to BUMP technology. In some embodiments, a user may cause an EGM to display an image on one of the EGM displays comprising a bar code, a QR code, or any other image that may be read, processed, and recognized by the mobile app using image detection hardware and software functionality, including but not limited to a camera, present in the PED. In some embodiments, either the PED or the EGM may display an alphanumeric identifier that may be manually entered by the player using one or more input devices available on the corresponding platform. In short, any novel, previously known, or later developed means whereby the two platforms may successfully and exclusively identify each other for communication purposes falls within the scope of the disclosure.

In some embodiments, a first application executing on a first device, such as PED 101, may be configured to locate second device(s), such as EGMs 102, via any location service available to the user of said first device. Present location service technologies include, but are not limited to, the use of GPS and other satellite-based services, known location(s) of wireless access points through which a device is accessing a wide area network (WAN) such as the Internet, the known location of cellular or other mobile network transmission towers, and the like. Multiple methods or the locations of more than one known transmission or reception point, combined with the measurement of transmitted or received signal levels, may be combined into a single location determination method. The scope of this disclosure is intended to apply without limitation to any location determination services that may later be developed. When the approximate or exact location of the first device is determined by any location determination service, the user of the first device may be presented with a map of known location(s) of second devices configured to offer corresponding games that are proximate to the location of the first device. These known location(s) of second devices may be extracted from one or more first-application-embedded or remote database(s) maintained by any third party such as the developer of the corresponding games. In lieu of the use of location services, the first application may be configured to allow the user to manually input a location specified in any preferred terms and a desired radius within which to search for second devices configured to offer games corresponding to a first game previously played on said first device.

In some embodiments, a first application executing on a first device, such as PED 101, may be configured to interoperate with other applications executing or available on said first device. A first application may comprise both game play functionality and service functionality related to the cooperative game play methods, wherein such service functionality may include communication functionality, device location functionality, authentication functionality, and the like. In some embodiments, some or all cooperative game service functionality may be provided by one or more second compatible applications operative on the same device. Said first application may then invoke any of said one or more second compatible applications only as necessary when their functionality is required, thereby reducing the processing power and memory required to execute a larger and all-encompassing first application. Preferably, the integration of first applications and second compatible applications is both seamless and highly configurable by each user.

In some embodiments, said one or more second compatible applications may be provided by the developer of a first application that comprises the code necessary to provide the cooperative game on the device in question. In some embodiments, said one or more second compatible application(s) may be compatible third party application(s) provided by one or more third party author(s) that offer functionality useful to, but not exclusively associated with, the cooperative game methods taught herein. As one non-limiting example, said first application may comprise a feature enabling a user to share his gaming results with a friend via social media or other means when previously configured by the user. In these embodiments, a first application provided by the cooperative game developer may automatically open an instance of a social media application already present on the user's device, such as a Twitter application, as a second compatible application, transfer data pertaining to the user's gaming results from said first application to said second compatible application, direct said second compatible application to transmit the information, and then close the second compatible application. Another non-limiting example would be enabling a user to configure said first application to access and execute a second compatible application in the form of a third party banking application to transfer funds from an authorized account to another device, such as EGM 102, IWAP 201, or remote gaming server(s) 107 to complete an e-commerce transaction such as purchasing EGM game play credits, games or other applications from a game developer, or the like. In some embodiments, a first application running on a first device may invoke an instance of a second compatible application on a second device for any purpose useful to the cooperative game method. For example, a first game application running on EGM 102 may invoke an instance of a second compatible application to execute of PED 101. As above, a user may be prompted by said first game application to purchase gaming credits by said first application automatically opening a second compatible third party banking application on PED 101, or a user's results from game play on EGM 102 may be communicated to PED 101 and automatically populated into one or more social media application(s) thereon. The possibilities for compatible first and second applications are plentiful, and any instance of a first cooperative game application invoking a second application from any source on the same device or a device in communication therewith for the purpose of providing additional functionality to said first application falls within the scope of this disclosure.

In addition to very stringent requirements for data communications in wager-based gaming environments, gaming regulations require extensive authentication of executable game code running on any EGM. Such code is required to be tested and approved by regulatory authorities prior to regular use in EGMs, and any modifications to said code after approval represents a potential malicious attack that may place both the operator and the gaming patron at risk of financial loss due to fraud.

In some embodiments of this invention, the EGM game comprises a series of modules configured as a whole to execute the game as designed and approved by pertinent regulatory authorities. Certain modules provide data exchange for user input and display purposes (I/O), others provide images and sounds used during game execution (data), others handle logging and secure communications related to the basic operation of the machine (OS/hardware), and a plurality of others provide the executable code necessary to locally generate or retrieve game outcomes from remote gaming servers, select the appropriate images and sounds to present the game outcome to the users, and retrieve and present those images and sounds on the EGM hardware (core game operations). Within the plurality of modules comprising the core game operations, certain modules resident in the EGM are configured to provide different game experiences according to the previous disclosure. Each of these modules are independently approved by gaming regulators and are periodically validated during operation of the machine as also required by regulation. In a sense, each module or combination of modules represents a different game available to a player, albeit highly similar games within the context of this invention that differ only by certain benefits and advantages present in some and not in others. In some embodiments, these modules may be downloaded on demand from a secured gaming server or in some embodiments, they may be resident in the EGM and stored in firmware, memory, or on magnetic media.

Just as with EGMs known in the art that offer players a selection of different variations of video poker games selectable by the player via touchscreen, EGMs configured to offer corresponding games according to the disclosed invention may have any number of core game operation modules available to present to the player. The difference between the modules in this system is that each module comprises game code that further comprises a different combination of benefits or advantages available to players entitled to benefit therefrom. Selection of a particular module comprising the particular game with certain benefits and advantages embedded in that module is analogous to a player selecting one of a dozen different variations of video poker using an EGM touchscreen as is known in the art. Novel elements of the system and method embodiments taught herein include the selection of the appropriately enabled module via an external device, such as a PED, and the fact that the particular enablements present in the modules available for selection are dependent on one or more benefits and advantages earned by a player based on participation in a corresponding game on a different platform.

In these embodiments, all modules associated with execution of the EGM game are completely protected and not accessible in any way by PED 101. An additional module present in the EGM game may be configured to communicate with PED 101 via specialized communication hardware dedicated solely to the cooperative game method for the singular purpose of receiving data pertaining to a player's benefits and advantages and passing said data to another secured module within the plurality of core game operation modules. The secured module would then select the appropriate game module associated with the player's benefits and advantages received from the PED and execute said module to provide the appropriate game to the player.

Numerous preferred embodiments of the systems and methods extensively disclosed herein are particularly well-suited for corresponding games offered on different platforms and devices as described. However, certain other preferred embodiments may be based on one or combinations of more than one element taught by Applicants using games which may or may not be considered to be corresponding games or by using devices consistent or inconsistent with the personal electronic device(s) and electronic gaming machines according to certain disclosures in this written description, without restriction. For example, benefit(s) and advantage(s) may be awarded to a player for his participation in a non-wagering entertainment game that may be applied to a wager-based game provided by an electronic gaming machine wherein said wager-based game is wholly different than the non-wagering entertainment game, or applied to a non-wager based entertainment game, or to any other game. Similarly, benefit(s) and advantage(s) may be awarded for promotional activities as taught herein but based on completely dissimilar (non-corresponding) games, or even awarded for use during play of the same game on the same platform toward which said promotional activity was directed. A person of ordinary skill in the art will recognize that the objective of game promotion, particularly but not exclusively via transformation of an electronic game (whether a wager-based game or a non-wagering entertainment game) from a first game play state to a second game play state, may be achieved by any number of combinations of the individual elements disclosed by Applicants. Further, any and all such combinations of those elements that may be used to promote the play of electronic games, particularly but not exclusively wager-based games provided by electronic gaming machines, is envisioned by Applicants and falls within the scope of this disclosure.

While the foregoing disclosure sets forth various exemplary embodiments using specific drawings and descriptions, one or more of said embodiments or other embodiments described in the preceding paragraph may be achieved by other means or functions evident to persons of ordinary skill in the art and are thereby also contemplated by the instant disclosure. For example, certain embodiments may be implemented in hardware structure, computer software or firmware, by one or more humans, by other means, or by any combination of some or all of the above. Applicant's disclosure in its written description and claims must be considered in its entirety for all it teaches and claims and not as a series of disparate and unrelated pieces. Certain elements of this invention may be independently operable but may not be properly separated from the invention as a whole for purposes of determining patentability. For example, combinations of known elements to achieve a system or method previously unknown in the art would, by definition, comprise a novel invention for purposes of patentability and would further comprise "significantly more" than the simple use of known elements to achieve predictable results. Reduction of Applicant's invention to disparate elements in an attempt to deem said invention as obvious over known art without appreciation for the novelty of the combination of said elements would fail to appreciate the invention as a whole.

With respect to methods and processes, it will be recognized by persons of ordinary skill in the art that certain of the steps in said methods or processes are not necessarily required to be performed in the order taught by Applicant's recitation. When process or method steps may be performed in an alternative order such that the results achieved by said process or method are equivalent to those taught by Applicant, such alternate order of performance are envisioned by the scope of this disclosure. A person of ordinary skill in the art will appreciate the extent to which one or more step(s) of any process or method taught or claimed herein must necessarily precede another, but in all other instances, the scope of Applicant's disclosure should be viewed as inclusive of the family of processes or methods comprising equivalent steps that achieve the results taught and claimed by Applicant's process and method steps in any order of performance. Further, certain process or method steps may not be required for one or more embodiments, and such embodiments also fall within the scope of this disclosure.

Unless otherwise noted herein, the descriptive articles "a" or "an," as used in the specification and claims are to be construed as meaning "at least one of". Thus, for example, recitation of combinations of elements such as "at least one of any of A, B, and C" describes any manner of combination of said elements, including combinations comprising A, B, C, A and B, A and C, B and C, or A and B and C.

Further, whenever the singular form of an object is used or implied, the use of the plural is understood to be included, and vice versa. For example, the term "input device" may refer to one such device or more than one such device. Terms denoting one or more, such as "input device(s)", are used herein for grammatical propriety where deemed applicable and are not to be distinguished from usage where only the singular or plural are used unless expressly stated otherwise.

Applicant has described its invention in the context of certain embodiments, some preferred over others in certain instances, for certain purposes, or both. The scope of this disclosure is intended to encompass all embodiments related to the disclosed subject matter and for all useful purposes to which said embodiments may be applied. The exemplary embodiments listed herein are provided to be enabling rather than limiting, as persons of ordinary skill in a great variety of arts will immediately recognize how the apparatus, systems, and methods disclosed herein may readily be applied to aspects of their arts, and such applications are therefore additionally enabled by Applicant's disclosure and therefore fall within its scope.

What is claimed is:

1. A system for transforming the play of an electronic wagering game on an electronic gaming machine via play of a non-wagering electronic entertainment game on a personal electronic device not configured for wager-based gaming, the system comprising:

A. at least one first personal electronic device owned by a user comprising one or more first electronic data communication port(s) and at least one non-wager-based application downloaded and installed by said user capable of providing a non-wagering electronic entertainment game;

B. at least one second electronic device comprising an electronic gaming machine, one or more second electronic data communication port(s), and at least one secure application capable of providing an electronic wagering game; and C. one or more remote game server(s) in electronic data communication with said at least one first personal electronic device, said at least one second electronic device, or said at least one first personal electronic device and said at least one second electronic device;

wherein:

a. said at least one first personal electronic device is configured to (i) generate instructions to modify the game play of said electronic wagering game based on the user's play of said non-wagering electronic entertainment game, and (ii) communicate said instructions to said at least one second electronic device via said one or more first electronic data communication port(s);

b. said at least one second electronic device is configured to (i) receive said instructions from said at least one first personal electronic device via said one or more second electronic data communication port(s) and (ii) provide said instructions to said electronic wagering game so as to transform said electronic wagering game from a first game play state to a second game play state comprising one or more enhancements to said first game play state; and c. (i) communications between said at least one first personal electronic device and said one or more remote game server(s) are routed through said at least one second electronic device, (ii) communications between said at least one second electronic device and said one or more remote game server(s) are routed through said at least one first personal electronic device, or (iii) communications between said at least one first personal electronic device and said one or more remote game server(s) are routed through said at least one second electronic device and communications between said at least one second electronic device and said one or more remote game server(s) are routed through said at least one first personal electronic device.

2. The system of claim 1 wherein said non-wagering electronic entertainment game and said electronic wagering game comprise at least one of any of a similar game theme, a common or similar graphics presentation, common or similar colors or color changes, a common or similar name, common or similar characters, common or similar game elements, common or similar placement of game elements in the game presentation, common or similar sounds, common or similar math models, or common or similar movements, velocities, acceleration, or trajectories of game or display elements.

3. The system of claim 1 wherein said one or more first electronic data communication port(s) and said one or more second electronic data communication port(s) are configured to establish one or more communication path(s) between said first personal electronic device and said second electronic device using at least one of any of Bluetooth®, NFC, ZigBee®, Wi-Fi®, Wi-Fi® Direct, BUMP technology, infrared optical transmission and reception, and audio transmission and reception.

4. The system of claim 1 further comprising one or more specialized communication interface machine(s), wherein said one or more second electronic data communication port(s) are provided to said at least one second electronic device by said one or more specialized communication interface machine(s) disposed within the cabinet of said at least one second electronic device and in bidirectional data communication with said at least one second electronic device.

5. The system of claim 1 further comprising one or more intermediate wireless access point(s) communicatively disposed (i) between at least one of any of said at least one first personal electronic device and said one or more remote game server(s), (ii) between said at least one second electronic device and said one or more remote game server(s), or (iii) between said at least one first personal electronic device and said one or more remote game server(s) and said at least one second electronic device and said one or more remote game server(s) such that communications between (a) said first personal electronic device and said one or more remote game server(s), (b) said second electronic device device(s) and said one or more remote game server(s), or (c) said first personal electronic device and said one or more remote game server(s) and said second electronic device device(s) and said one or more remote game server(s) are routed through said one or more intermediate wireless access points.

6. The system of claim 5 wherein said at least one first personal electronic device or the user of said at least one first personal electronic device is authenticated to (i) said at least one second electronic device, (ii) said one or more remote game server(s), or (iii) said second electronic device and said one or more remote game server(s) via one or more authentication services provided at least in part by at least one of any of said personal electronic device, said electronic gaming machine, said one or more intermediate wireless access point(s), and said one or more remote game server(s).

7. The system of claim 1 wherein (i) said instructions generated during the play of said non-wagering electronic entertainment game may only be applied to transform the play of said electronic wagering game and not to transform the play of said non-wagering electronic entertainment game, (ii) said transformation of the play of said electronic wagering game may only be achieved via instructions generated during the play of said non-wagering entertainment game and may not be achieved during the play of said electronic wagering game, or (iii), both (i) and (ii) above.

8. A method of transforming the play of an electronic wagering game via play of a non-wagering electronic entertainment game, the method comprising:

A. providing a user-downloadable and user-installable non-wagering electronic entertainment game configured to execute on a first personal electronic device not configured for wager-based gaming;

B. providing an electronic wagering game configured to execute on a second electronic device comprising a microprocessor-based electronic gaming machine;

C. providing one or more remote game server(s) in data communication with either or both of said first personal electronic device and said second electronic device;

D. playing said non-wagering electronic entertainment game on said personal electronic device and accruing one or more electronic wagering game benefit(s) or advantage(s) as a result of said playing;

E. communicating said one or more benefit(s) or advantage(s) from said personal electronic device to said second electronic device wherein such communication between any two of said first personal electronic device, said second electronic device, and said one or more remote game server(s) comprises an additional intermediate step of routing said data communication via the third of said first personal electronic device, said second electronic device, and at least one of said one or more remote game server(s); and F. applying said one or more communicated benefit(s) or advantage(s) to said electronic wagering game so as to transform said second electronic game from a first game play state to a second game play state comprising one or more enhancements to said first game play state.

9. The method of claim 8 wherein said non-wagering electronic entertainment game and said electronic wagering game comprise at least one of any of a similar game theme, a common or similar graphics presentation, common or similar colors or color changes, a common or similar name, common or similar characters, common or similar game elements, common or similar placement of game elements in the game presentation, common or similar sounds, common or similar math models, or common or similar movements, velocity, acceleration, trajectories, etc. of game or display elements.

10. The method of claim 8 further comprising a step of providing one or more intermediate wireless access point(s) and the step of communicating data between any two of said first personal electronic device, said second electronic device, and said one or more remote game server(s) comprises an additional intermediate step of routing said communication via at least one of said one or more intermediate wireless access points.

11. The method of claim 10 comprising the additional step of authenticating said first personal electronic device or the user of said personal electronic device to (i) said second electronic device, (ii) said one or more remote game server(s), or(iii) said second electronic device and said one or more remote game server(s) via one or more authentication services provided at least in part by at least one of any of said personal electronic device, said electronic gaming machine, said one or more intermediate wireless access point(s), and said one or more remote game server(s).

12. The method of claim 8 wherein (i) said accrued electronic wagering game benefit(s) or advantage(s) may only be applied to transform the play of said electronic wagering game and not to transform the play of said non-wagering game, (ii) said accrued electronic wagering game benefit(s) or advantage(s) may only be earned during the play of said electronic non-wagering game and not during the play of said electronic wagering game, or (iii) both (i) and (ii) above.

13. A method of transforming an electronic wagering game, the method comprising:

A. downloading and installing, by a user, (i) a non-wagering electronic entertainment game configured to execute on a personal electronic device not configured for wager-based gaming and (ii) an electronic wagering game executing on a microprocessor-based electronic gaming machine;

B. accruing one or more electronic wagering game benefit(s) or advantage(s) during play of said non-wagering electronic entertainment game;

C. communicating said one or more benefit(s) or advantage(s) to said electronic wagering game wherein such communication between any two of said personal electronic device, said electronic gaming machine, and one or more remote game server(s) comprises an additional intermediate step of routing said data communication via the third of said personal electronic device, said electronic gaming machine, and at least one of said one or more remote game server(s); and D. transforming said electronic wagering game by modifying the game play to add one or more enhancements in accordance with said one or more benefit(s) or advantage(s).

14. The method of claim 13 wherein the step of communicating said one or more benefit(s) or advantage(s) to said electronic wagering game comprises the additional intermediate step of routing said communication via (i) one or more intermediate wireless access points or (ii) (iii) said one or more intermediate wireless access points and said one or more remote game server(s).

15. The method of claim 14 comprising the additional step of authenticating said communication of said one or more benefit(s) or advantage(s) via one or more authentication services provided at least in part by at least one of any of said personal electronic device, said electronic gaming machine, said one or more intermediate wireless access point(s), and said one or more remote game server(s).

16. The method of claim 13 wherein (i) said accrued electronic wagering game benefit(s) or advantage(s) may only be applied to add one or more enhancements to the electronic wagering game and not to said non-wagering electronic game, (ii) said accrued electronic wagering game benefit(s) or advantage(s) may only be earned during play of said non-wagering electronic game and not during play of said electronic wagering game, or (iii) both (i) and (ii) above.

17. The system of claim 6 wherein said one or more authentication services comprise at least one of any methods comprising a user name and password, one or more keys, tokens, digital certificate information exchanges, hashes, encrypted or encoded data, challenge/response, biometric information, image recognition, bar codes, and QR codes.

18. The system of claim 11 further configured to periodically re-authenticate said personal electronic device, said user, or both.

19. The method of claim 11 wherein the step of authenticating said first personal electronic device or the user of said personal electronic device comprises at least one of any methods comprising a user name and password, one or more keys, tokens, digital certificate information exchanges, hashes, encrypted or encoded data, challenge/response, biometric information, image recognition, bar codes, and QR codes.

20. The method of claim 11 further comprising a step of periodically re-authenticating said personal electronic device, said user, or both.

* * * * *